US007076187B2

(12) United States Patent
Jeong et al.

(10) Patent No.: US 7,076,187 B2
(45) Date of Patent: Jul. 11, 2006

(54) ELECTROPHOTOGRAPHIC PRINTER

(75) Inventors: Heung-sup Jeong, Suwon-si (KR); Se-hyun Lyu, Seoul (KR); Jae-myoung Choi, Suwon-si (KR); Jin-soo Lee, Suwon-si (KR); Woo-chul Jung, Yongin-si (KR); Young-min Yoon, Yongin-si (KR); Heung-kyu Jang, Suwon-si (KR); Byeong-hwa Ahn, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 10/822,002

(22) Filed: Apr. 12, 2004

(65) Prior Publication Data

US 2005/0002689 A1 Jan. 6, 2005

(30) Foreign Application Priority Data

Jul. 4, 2003 (KR) ..... 10-2003-0045393

(51) Int. Cl.
*G03G 15/00* (2006.01)
*G03G 15/01* (2006.01)

(52) U.S. Cl. ..... 399/110; 399/111; 399/112; 399/125; 399/223

(58) Field of Classification Search ..... 399/111, 399/110, 124, 125, 113, 119, 112, 223, 298, 399/117, 107

See application file for complete search history.

(56) References Cited

U.S. PATENT DOCUMENTS

| | | | | |
|---|---|---|---|---|
| 5,537,188 | A * | 7/1996 | Haneda | 399/112 |
| 5,742,319 | A * | 4/1998 | Fukunaga et al. | 399/113 X |
| 5,752,133 | A * | 5/1998 | Nagase et al. | 399/112 |
| 6,104,897 | A * | 8/2000 | Ishizawa | 399/119 |
| 6,125,251 | A * | 9/2000 | Shiraishi et al. | 399/124 |
| 6,501,925 | B1 * | 12/2002 | Yamamoto et al. | 399/110 X |
| 2004/0085431 | A1 * | 5/2004 | Asuwa et al. | 347/129 |
| 2004/0096240 | A1 * | 5/2004 | Kim | 399/222 |
| 2004/0101328 | A1 * | 5/2004 | Kimura et al. | 399/111 |

FOREIGN PATENT DOCUMENTS

| | | | |
|---|---|---|---|
| JP | 2000-347473 | A * | 12/2000 |
| JP | 2001-209229 | A * | 8/2001 |

* cited by examiner

*Primary Examiner*—Sophia S. Chen
(74) *Attorney, Agent, or Firm*—Stanzione & Kim, LLP

(57) ABSTRACT

An electrophotographic includes a main frame, a photosensitive drum unit having a photosensitive drum and vertically detachably installed on the main frame, a plurality of development units each having a developing roller and detachably installed on the main frame while sliding in a horizontal direction, and a first door openably installed for mounting or dismounting the plurality of development units.

26 Claims, 18 Drawing Sheets

ELECTROPHOTOGRAPHIC PRINTER

CROSS-REFERENCE TO RELATED APPLICATIONS

This application claims the priority of Korean Patent Application No. 2003-45393, filed on Jul. 4, 2003, in the Korean Intellectual Property Office, the disclosure of which is incorporated herein in its entirety by reference.

BACKGROUND OF THE INVENTION

1. Field of the Invention

The present invention relates to an electrophotographic printer, and more particularly, to an electrophotographic printer having multiple doors to access disposables.

2. Description of the Related Art

In general, electrophotographic printers form an electrostatic latent image by radiating light on a photosensitive medium charged to a predetermined potential, develop the electrostatic latent image using a toner having a predetermined color image to form a toner image, transfer the toner image onto a recording medium, and fuse the toner image on the recording medium, thereby printing a monochromic or a multi-color image.

Electrophotographic printers are typically classified into wet type electrophotographic printers and dry type electrophotographic printers according to a developer used. A wet type electrophotographic printer uses a developer having powdered toner dispersed in a liquid carrier. A dry type electrophotographic printer uses a two-component developer having a powdered carrier mixed with a toner, or a one-component developer without the carrier. The dry type electrophotographic printer will now be described, and the term "developer" used throughout the specification indicates a toner for convenience sake.

Printing of a color image generally requires yellow (Y), magenta (M), cyan (C) and black (K) toners. Accordingly, four development units for developing the respective color toners are needed. Either a single-pass printing, which requires four exposure units and a photosensitive medium, or a multi-pass printing, which requires a single exposure unit and a photosensitive medium, may be employed in printing a color image. In either case, four development units are necessary.

A single-pass printing process allows high-speed printing for both a monochromic image and a color image because printing is performed in a single pass in both cases. On the other hand, although a multi-pass printing process requires a printing time for the color image four or more times longer than that for the monochromic image, it can be implemented by a simplified structure.

In the above-described electrophotographic printer, development units, photosensitive media or transfer media are disposables that can be replaced when they are used up. The electrophotographic printer is configured such that disposables can be replaced.

SUMMARY OF THE INVENTION

The present invention provides a dry type electrophotographic printer having an improved structure capable of easily mounting or dismounting disposables such as a photosensitive drum, a developing device and/or a transfer medium.

Also, the present invention provides a dry type, multi-pass electrophotographic printer configured to be capable of preventing damage of disposables due to a mutual interference of the disposables during mounting or dismounting of the disposables.

The present invention also provides a dry type electrophotographic printer configured to be capable of easily removing a paper jam.

Additional aspects and advantages of the invention will be set forth in part in the description which follows and, in part, will be obvious from the description, or may be learned by practice of the invention.

The foregoing and/or other aspects of the present invention are achieved by providing an electrophotographic printer comprising a main frame, a photosensitive drum unit having a photosensitive drum and vertically detachably installed on the main frame, a plurality of development units each having a developing roller and detachably installed on the main frame while sliding in a horizontal direction, and a first door openably installed to mount or dismount the plurality of development units.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
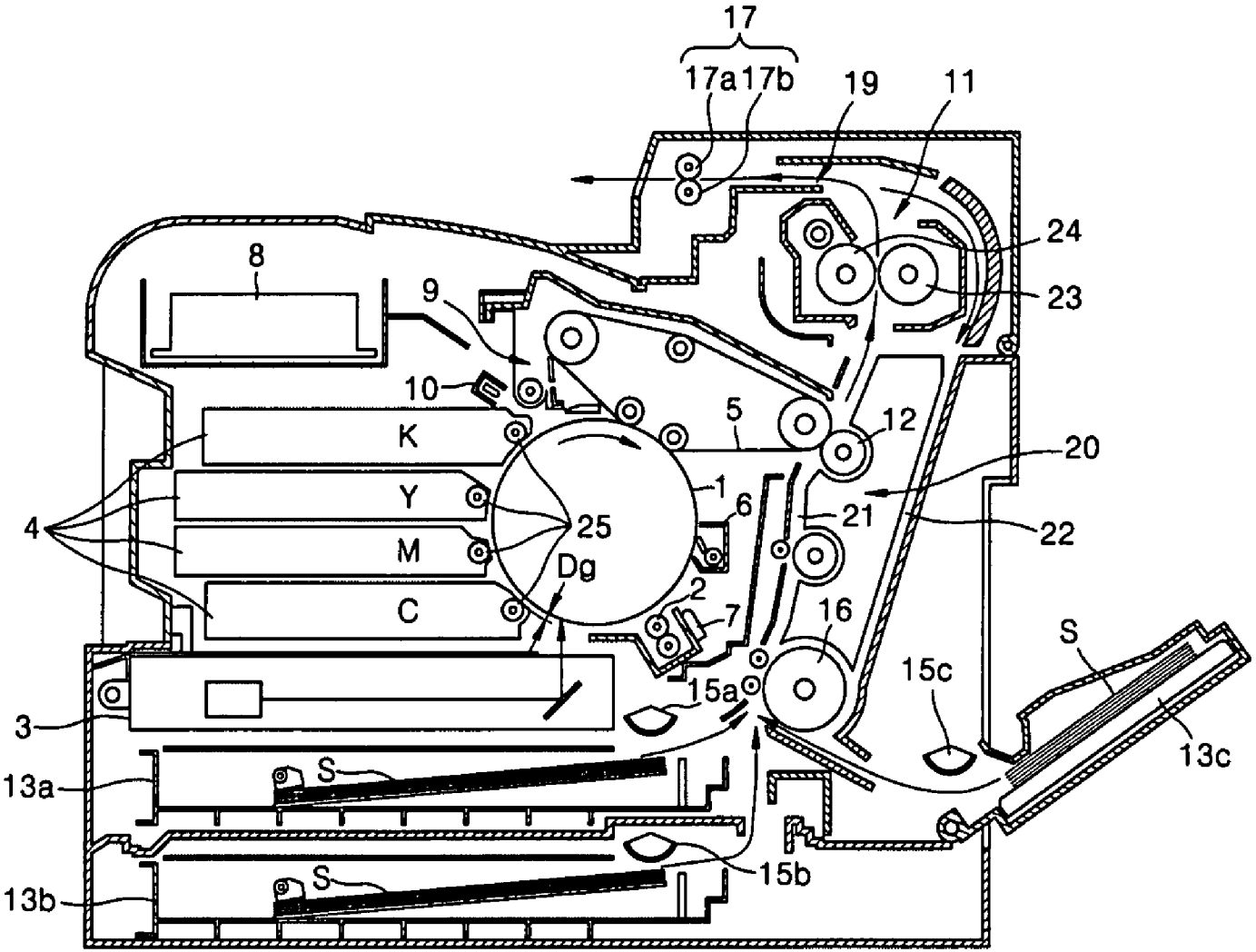
FIG. 1 is a schematic diagram of an electrophotographic printer according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 is a schematic diagram of an electrophotographic printer according to an embodiment of the present invention.

Referring to FIG. 1, the electrophotographic printer according to an embodiment of the present invention includes a photosensitive drum 1, a charge roller 2, an exposing unit 3, four development units 4, and a transfer belt 5.

The photosensitive drum 1 can be a cylindrical metal drum having a photoconductive layer formed on its outer circumferential surface.

The charge roller 2 is a charger that can uniformly charge the photosensitive drum 1. The charge roller 2 supplies charges to the photosensitive drum 1 while rotating in a contact or non-contact manner with respect to the outer circumferential surface of the photosensitive drum 1, thereby making the outer circumferential surface of the photosensitive drum 1 have a uniform potential. A corona discharger (not shown) can be used as the charger, instead of the charge roller 2.

The exposing unit 3 can be disposed below the photosensitive drum 1, and irradiates light corresponding to an image information onto the uniformly charged photosensitive drum 1, thereby forming an electrostatic latent image on the photosensitive drum 1. A laser scanning unit (LSU) using a laser diode as a light source, is generally used as the exposing unit 3.

Four development units 4C, 4M, 4Y and 4K contain solid powdered toners of cyan (C), magenta (M), yellow (Y) and black (K), respectively, and each of the development units 4C, 4M, 4Y and 4K includes a developing roller 25 to supply each respective toner to the electrostatic latent image formed on the photosensitive drum 1 and form a toner image. The four development units 4C, 4M, 4Y and 4K may be configured such that the developing roller 25 is spaced apart from the outer circumferential surface of the photosensitive drum 1 by a developing gap Dg. The developing gap Dg can be several tens to several hundreds of microns.

Cyan (C), magenta (M), yellow (Y) and black (K) toner images sequentially formed on the photosensitive drum 1 are in turn transferred to the transfer belt 5 and overlap, thereby forming a multi-color toner image. A linear traveling speed of the transfer belt 5 can be the same as a linear rotating speed of the photosensitive drum 1. A length of the transfer belt 5 should be the same or longer than a length of a sheet of paper (S) (or other recording medium) on which a multi-color toner image is finally formed.

Reference numeral 12 denotes a transfer roller. The transfer roller 12 is opposite to and faces the transfer belt 5. While the multi-color toner image is being transferred to the transfer belt 5, the transfer roller 12 is spaced apart from the transfer belt 5, and when the multi-color toner image is completely transferred to the transfer belt 5, the transfer roller 12 contacts the transfer belt 5 with a predetermined pressure to transfer the multi-color toner image to the sheet of paper S.

Reference numeral 6 denotes a first cleaning device to remove waste toner remaining on the outer circumferential surface of the photosensitive drum 1 after the toner image is transferred to the transfer belt 5. The waste toner collected by the first cleaning device 6 is stored in a waste toner storage container (not shown).

Reference numeral 9 denotes a second cleaning device to remove waste toner remaining on the transfer belt 5 after the toner image is transferred to the sheet (S). The waste toner collected by the second cleaning device 9 is stored in a waste toner storage container (not shown).

Reference numeral 10 denotes a pre-transfer eraser. The pre-transfer eraser 10 removes charges from a non-image region of the photosensitive drum 1 before the toner image formed on the photosensitive drum 1 is transferred to the transfer belt 5, thereby improving transfer efficiency from the photosensitive drum 1 to the transfer belt 5.

Reference numeral 7 denotes an erasing lamp. The erasing lamp 7 is an eraser to erase charges remaining on the outer circumferential surface of the photosensitive drum 1 prior to charging. The erasing lamp 7 irradiates a predetermined amount of light onto the outer circumferential surface of the photosensitive drum 1 and erases the charges remaining on the photosensitive drum 1.

Reference numeral 8 denotes a power supply. The power supply 8 supplies a developing bias to develop a toner from the developing device 4 to the photosensitive drum 1, a development preventing bias to prevent toner from adhering to the photosensitive drum 1 from the developing device 4, a first transfer bias to transfer a toner image from the photosensitive drum 1 to the transfer belt 5, a second transfer bias to transfer the toner image from the transfer belt 5 to the sheet S, and a charge bias applied to the charge roller 2 to charge the photosensitive drum 1.

Reference numeral 11 is a fusing device to fix the toner image transferred to the sheet S on the sheet S. A fusing device 11 according to this embodiment is configured such that a pair of rollers 23 and 24 rotate in engagement with each other with a predetermined pressure. At least one of the pair of rollers 23 and 24 has a heating unit (not shown) to heat the toner image. In the illustrative embodiment, the heating unit is provided at each of the two rollers 23 and 24. When the sheet S to which the toner image is transferred passes through the fusing device 11, the toner image is fixed on the sheet S by heat and pressure, thereby completing image printing.

Reference numeral 13*a* denotes a feed cassette, for example, a sheet supplying unit. The sheet supplying unit may further include a second feed cassette 13*b* and/or a multi-purpose feeder (MPF) 13*c*. The MPF 13*c* is typically used to transport non-regular sheets or overhead projector (OHP) sheets.

Reference numeral 16 denotes a feed roller to transport the sheet S fed from the feed cassette 13*a*, the second feed cassette 13*b* or the MPF 13*c* by a pickup roller 15*a*, 15*b* and 15*c*, respectively.

Reference numeral 17 denotes an ejection roller to eject the sheet S after printing. A sheet transport unit 20 includes a feed path 21 to guide the sheet S between the feed roller 16 and the fusing device 11, and a duplex path 22 to provide duplex printing.

The sheet S, having an image printed on one side thereof and being fed past the fusing device 11, is ejected through a path 19 by the ejection roller 17 (17*a* and 17*b*). For duplex printing, the ejection roller 17 rotates in a reverse direction and the sheet S is transported from the path 19 to a duplex path 22. Then, the sheet S is reversed so as to print an image on the other side thereof. The reversed sheet S is transported again via the feed path 21 by the feed roller 16 and printing is performed on the other side of the sheet S.

An image forming process using the electrophotographic printer having the above-described construction will now be described.

Multi-color image information includes pieces of information on cyan (C), magenta (M), yellow (Y) and black (K). In an aspect of the present invention, cyan (C), magenta (M), yellow (Y) and black (K) toner images overlap on the transfer belt 5 in that order, and then are transferred to the sheet S to be fixed thereon, thereby forming a multi-color image.

The outer circumferential surface of the photosensitive drum 1 is uniformly charged by the charge roller 2. If a light signal corresponding to cyan (C) image information is irradiated onto the rotating photosensitive drum 1 by the exposing unit 3, resistance of a portion onto which the light signal is irradiated is reduced and charges on the outer circumferential surface of the photosensitive drum 1 escape. Thus, a potential difference is generated between the light irradiated portion and a non-irradiated portion, thereby forming an electrostatic latent image on the outer circumferential surface of the photosensitive drum 1.

When the photosensitive drum 1 rotates to make the electrostatic latent image approach the cyan development unit 4C, rotation of a developing roller 25 of the cyan development unit 4C is commenced. Then, a development bias is applied from a power supply 8 to the developing roller 25 of the cyan development unit 4C. Meanwhile, a development preventing bias is applied to developing rollers 25 of the other development units 4M, 4Y and 4K. Then, only the cyan toner sticks to the electrostatic latent image formed on the outer circumferential surface of the photosensitive drum 1 across a developing gap Dg, thereby forming a cyan toner image.

When the photosensitive drum 1 rotates to make the cyan toner image approach the transfer belt 5, the cyan toner image is transferred to the transfer belt 5 by a first transfer bias and/or a contact pressure between the photosensitive drum 1 and the transfer belt 5.

After the cyan toner image is completely transferred to the transfer belt 5, magenta (M), yellow (Y) and black (K) toner images overlap on the transfer belt 5 through the above-described process.

During the above-described process, the transfer roller 12 is spaced apart from the transfer belt 5. If the four color toner images are all transferred to and overlap on the transfer belt 5 and a multi-color toner image is formed on the transfer belt 5, the transfer roller 12 contacts the transfer belt 5 to transfer the multi-color toner image on the sheet S.

The sheet S is supplied from a feed cassette 13*a*, a second feed cassette 13*b* or an MPF 13*c* so that a leading edge of the sheet S reaches a contact point of the transfer belt 5 and the transfer roller 12 when a leading edge of the multi-color toner image formed on the transfer belt 5 reaches the contact point. If the sheet S passes between the transfer belt 5 and the transfer roller 12, the multi-color toner image is transferred to the sheet S by a second transfer bias and fixed on the sheet S by the fusing device 11 by heat and pressure, and the sheet S having the fixed multi-color toner image is then ejected through the path 19, thereby completing formation of a color image.

For subsequent printing operations, first and second cleaning devices 6 and 9 remove waste toner remaining on the photosensitive drum 1 and the transfer belt 5, respectively, and an erasing lamp 7 irradiates light onto the photosensitive drum 1 to remove residual charges on the photosensitive drum 1.

Figure 2:
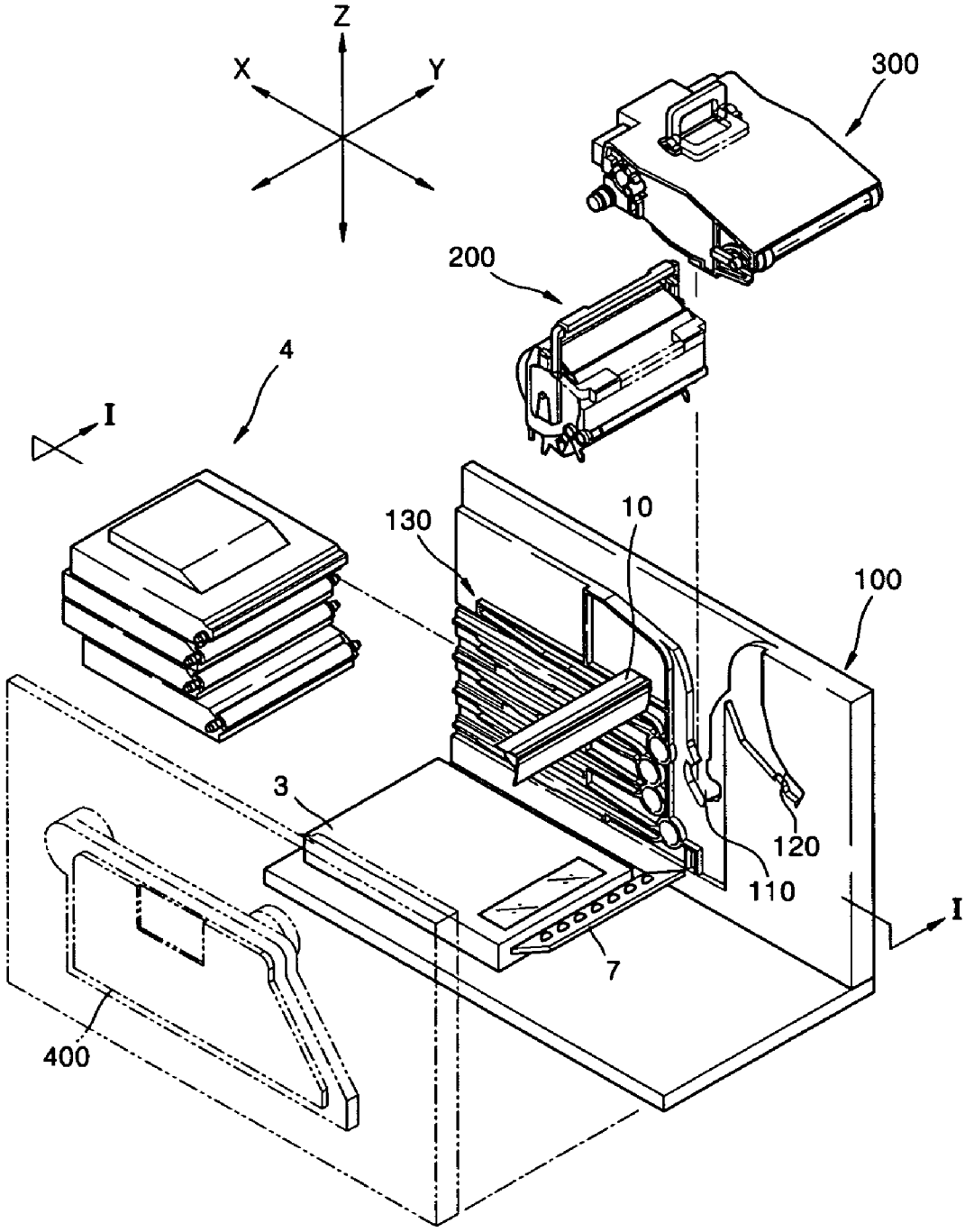
FIG. 2 is an exploded perspective view of the electrophotographic printer shown in FIG. 1.
Figure 3:
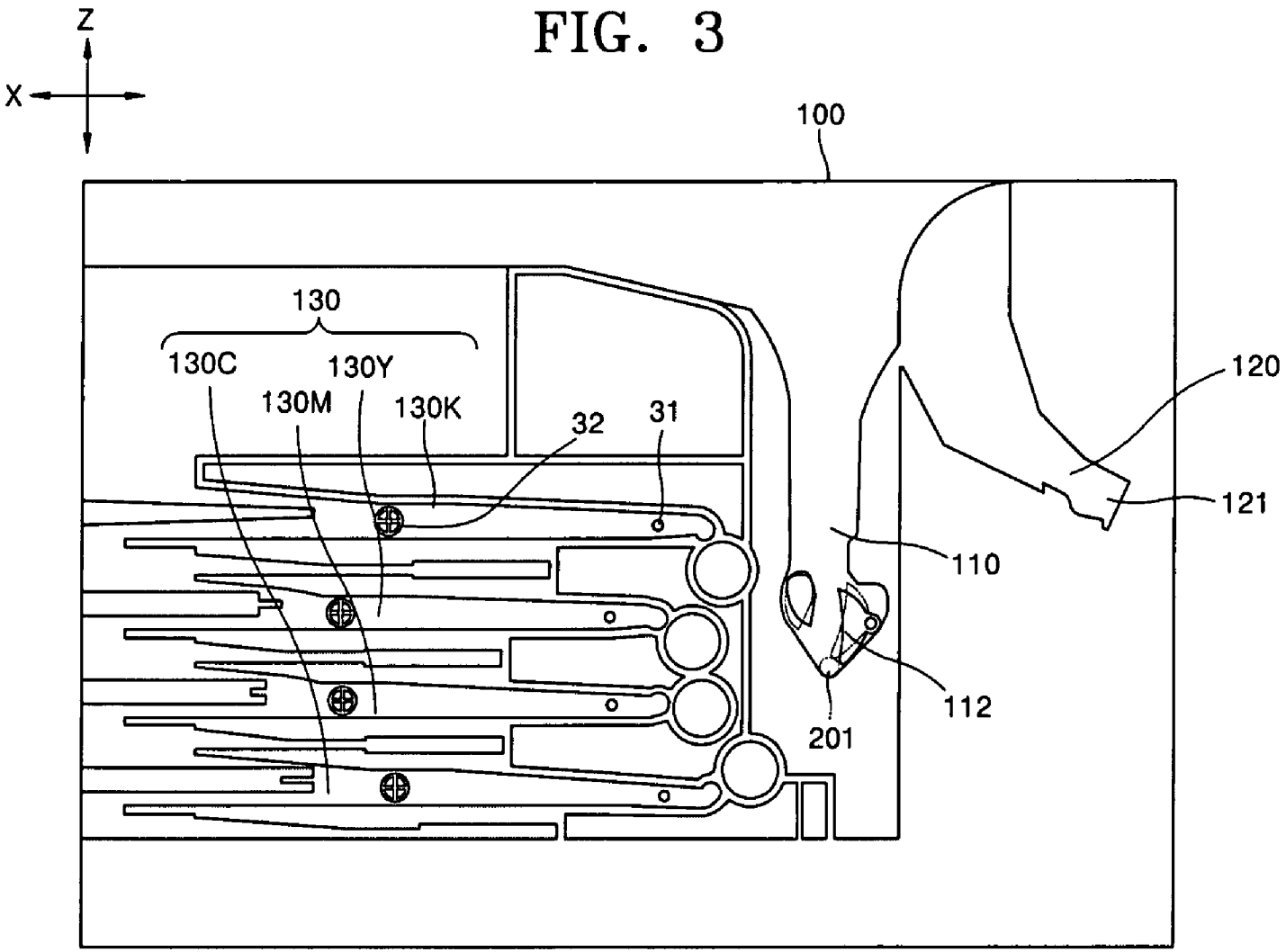
FIG. 3 is a cross-sectional view taken along a line I–I' of FIG. 2.

FIG. 2 is an exploded perspective view of the electrophotographic printer shown in FIG. 1, and FIG. 3 is a cross-sectional view taken along the line I—I of FIG. 2.

Referring to FIG. 2, on a main frame 100 are installed a photosensitive drum unit 200 having the photosensitive drum 1, an intermediate transfer unit 300 having the transfer belt 5, and the four development units 4C, 4M, 4Y and 4K each having the developing roller 25.

The photosensitive drum unit 200 can be mounted or dismounted in a vertical direction Z. The intermediate transfer unit 300 can be disposed above the photosensitive drum unit 200 and can also be mounted or dismounted in the vertical direction Z. The development units 4C, 4M, 4Y and 4K can be slidably installed so as to be mounted or dismounted in a horizontal direction X from a lateral side of the photosensitive drum 1. In the illustrative embodiment, the development units 4C, 4M, 4Y and 4K are arranged such that the cyan development unit 4C, the magenta development unit 4M, the yellow development unit 4Y and the black development unit 4K are sequentially disposed upward in that order from the bottom. However, other sequential orders of the development units 4C, 4M, 4Y and 4K may be provided alternatively to perform the intended aspects and features of the present embodiment as described herein. The pre-transfer eraser 10 can be disposed above the uppermost development unit 4K. The exposing unit 3 and the erasing lamp 7 can be disposed under the photosensitive drum unit 200. Reference numeral 400 denotes a waste toner storage container to store waste toner generated during printing. The waste toner storage container 400 can be installed so as to be mounted on or dismounted from the main frame 100 in a lengthwise direction Y of the photosensitive drum 1. Although not shown, the sheet transport unit 20 can be rotatably installed at the opposite side of the electrophotographic printer with respect to the development units 4C, 4M, 4Y and 4K in view of the photosensitive drum unit 200.

Referring to FIG. 3, the main frame 100 includes a first rail 110, a second rail 120 and third rails 130. The first rail 110 may be formed in the vertical direction Z as illustrated in FIG. 3 so that the photosensitive drum unit 200 can be mounted thereon in a vertical direction. The second rail 120 can slope downward so that the intermediate transfer unit 300 can be mounted thereon. The third rails 130 (130C, 130M, 130Y, 130K) can be formed in the horizontal direction X so that the development units 4C, 4M, 4Y and 4K are slidably mounted thereon. Although not shown, the first through third rails 110, 120 and 130 can be provided in pairs on respective opposite sides of the main frame 100, the pairs being opposite to each other. Reference numeral 112 denotes a fixing unit to fix the photosensitive drum unit 200 on the main frame 100 such that it rotates to reach a position indicated by a dotted line when the photosensitive drum unit 200 is completely mounted thereon.

Figure 4:
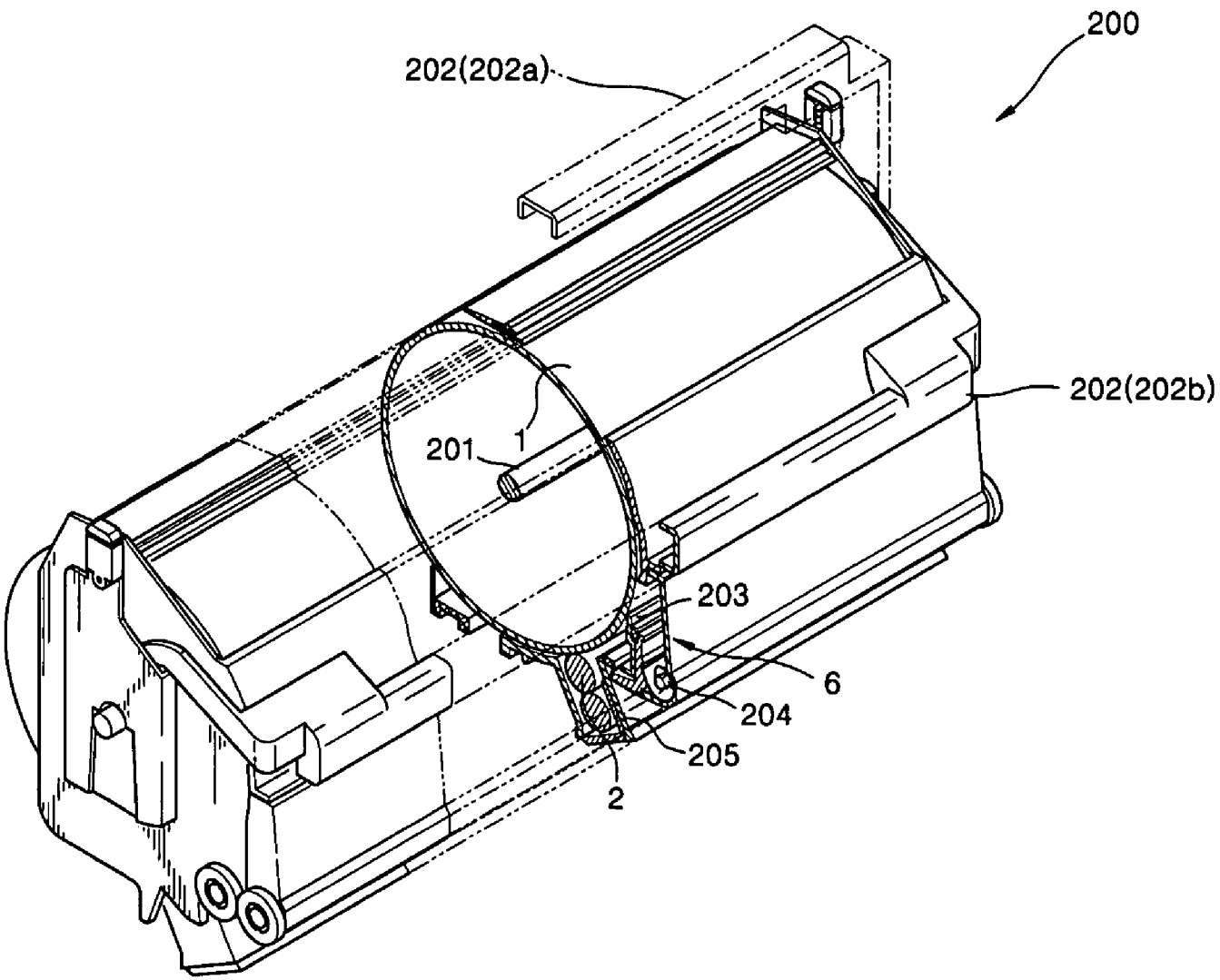
FIG. 4 is a perspective view of a photosensitive drum unit shown in FIG. 2.

FIG. 4 is a perspective view of the photosensitive drum unit shown in FIG. 2.

Referring to FIG. 4, the photosensitive drum unit 200 includes a photosensitive drum 1 rotatably installed on a shaft 201. The photosensitive drum unit 200 may further include a first cleaning device 6. Also, the photosensitive drum unit 200 may further include a charge roller 2. The photosensitive drum unit 200 may further include a light guiding member 205 to guide light irradiated from the erasing lamp 7 installed on the main frame 100 to the photosensitive drum 1. Also, the photosensitive drum unit 200 may further include a handle 202 rotatably installed on the shaft 201. The handle 202 can be rotated to a position referenced by 202*a* when the photosensitive drum unit 200 is mounted on or removed from the main frame 100, and can be rotated to a position referenced by 202*b* after the photosensitive drum unit 200 is mounted on the main frame 100. The first cleaning device 6 may include a first blade 203 to scrape waste toner remaining on the surface of the photosensitive drum 1 in contact with the photosensitive drum 1 after the transfer process, and a first transport unit 204 to transport the waste toner to a waste toner storage container 400. An auger having a spiral blade and rotating to transport waste toner can be used as the first transport unit 204. Ends of the shaft 201 can be inserted into the first rail 110 provided on the main frame 100, at which point the photosensitive drum unit 200 can then be guided by the first rail 110 to be mounted or dismounted in the vertical direction.

Figure 5:
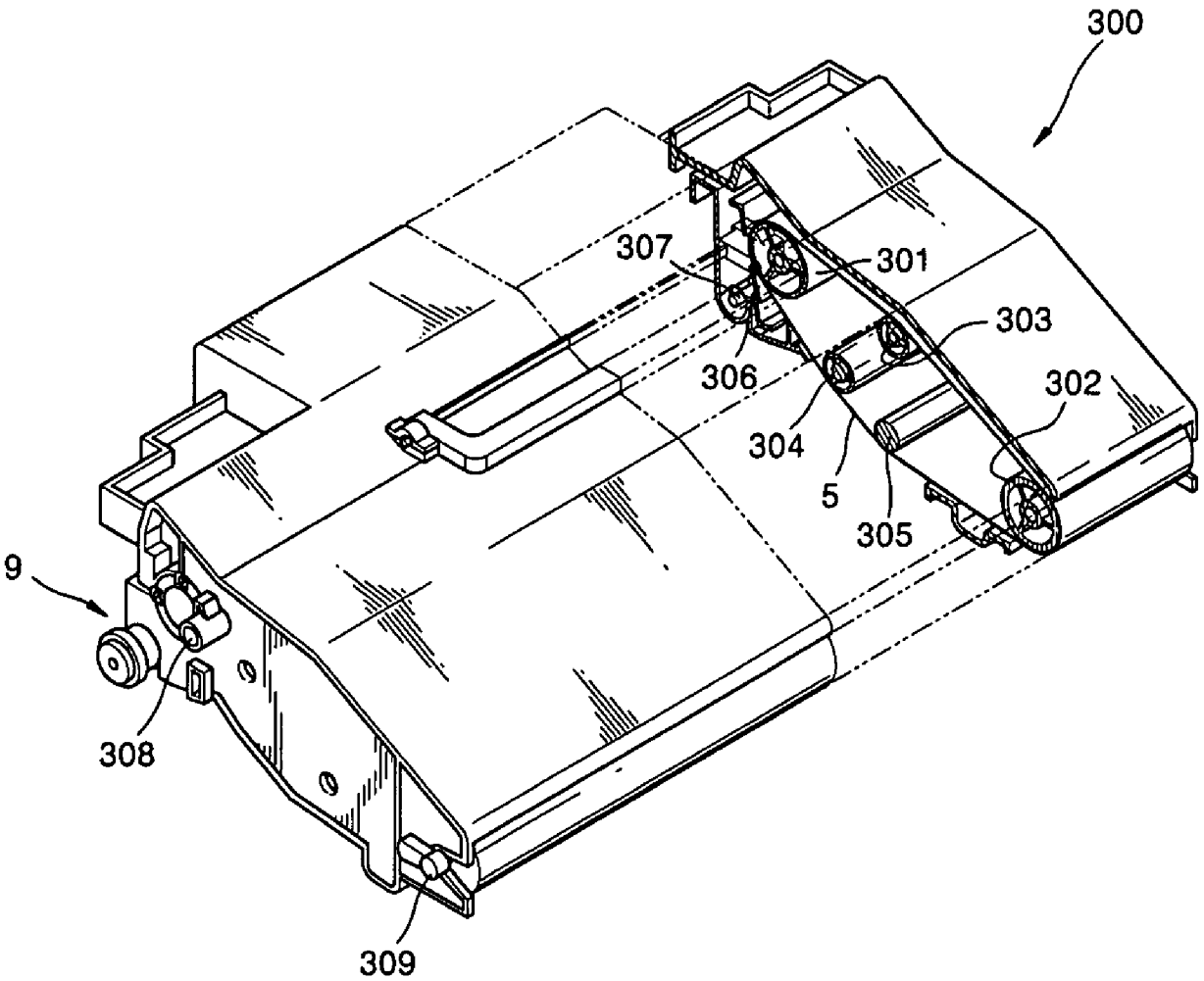
FIG. 5 is a perspective view of an intermediate transfer unit shown in FIG. 2.

FIG. 5 is a perspective view of the intermediate transfer unit shown in FIG. 2.

Referring to FIG. 5, the intermediate transfer unit 300 includes the transfer belt 5 and a plurality of first through fifth support rollers 301, 302, 303, 304 and 305, respectively, to rotatably support the transfer belt 5. The transfer belt 5 is generally positioned opposite to and faces the photosensitive drum 1 when it is positioned at a section between the fourth support roller 304 and the fifth support roller 305. At the section between the fourth support roller 304 and the fifth support roller 305, a toner image is transferred from the photosensitive drum 1 to the transfer belt 5. A first transfer bias, to allow the toner image formed on the photosensitive drum 1 to be transferred to the transfer belt 5, is applied to the fifth support roller 305. The second support roller 302 is opposite to and faces the transfer roller 12 shown in FIG. 1.

The intermediate transfer unit 300 may further include a second cleaning device 9 to remove waste toner remaining on the transfer belt 5 after the toner image is transferred to the sheet S (or other recording medium). The second cleaning device 9 may include a second blade 306 to scrape waste toner remaining on the surface of the photosensitive drum 1 in contact with the transfer belt 5, and a second transport unit 307 to transport the waste toner to the waste toner storage container 400. An auger having a spiral blade and rotating to transport waste toner can be used as the second transport unit 307.

A first supporting unit 308 and a second supporting unit 309 can be provided at opposite sides of the intermediate transfer unit 300. The first supporting unit 308 and the second supporting unit 309 can be inserted into the first rail 110 and the second rail 120, respectively. The first supporting unit 308 can be provided in the vicinity of the support roller 301, and the second supporting unit 309 can be provided in the vicinity of the support roller 302. To install the intermediate transfer unit 300 into the main frame 100, the second supporting unit 309 is first inserted into the second rail 120, and when the second supporting unit 309 reaches an end 121 of the second rail 120, the intermediate transfer unit 300 is tilted, and the first supporting unit 308 is inserted into the first rail 110 and pressed downward, so that the intermediate transfer unit 300 is mounted on the main frame 100.

Figure 6:
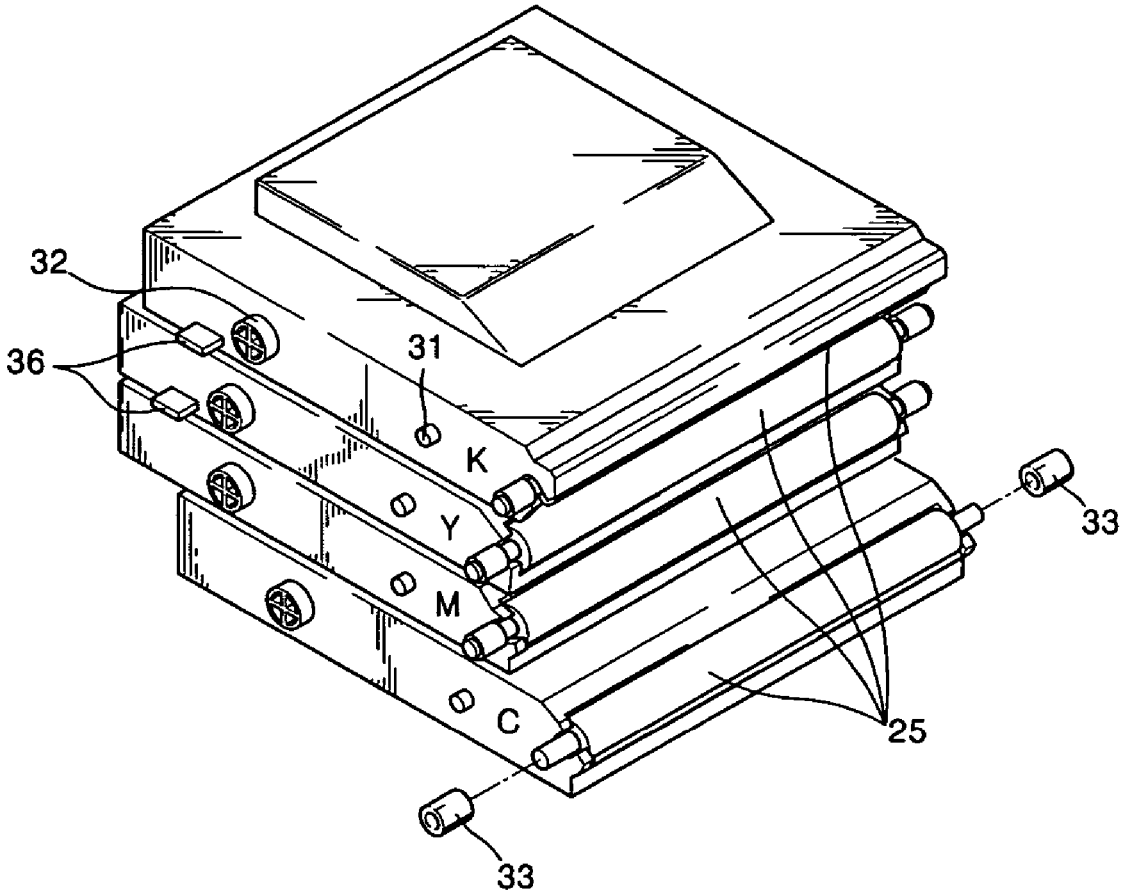
FIGS. 6 and 7 are perspective views of a developing device shown in FIG. 2.
Figure 7:
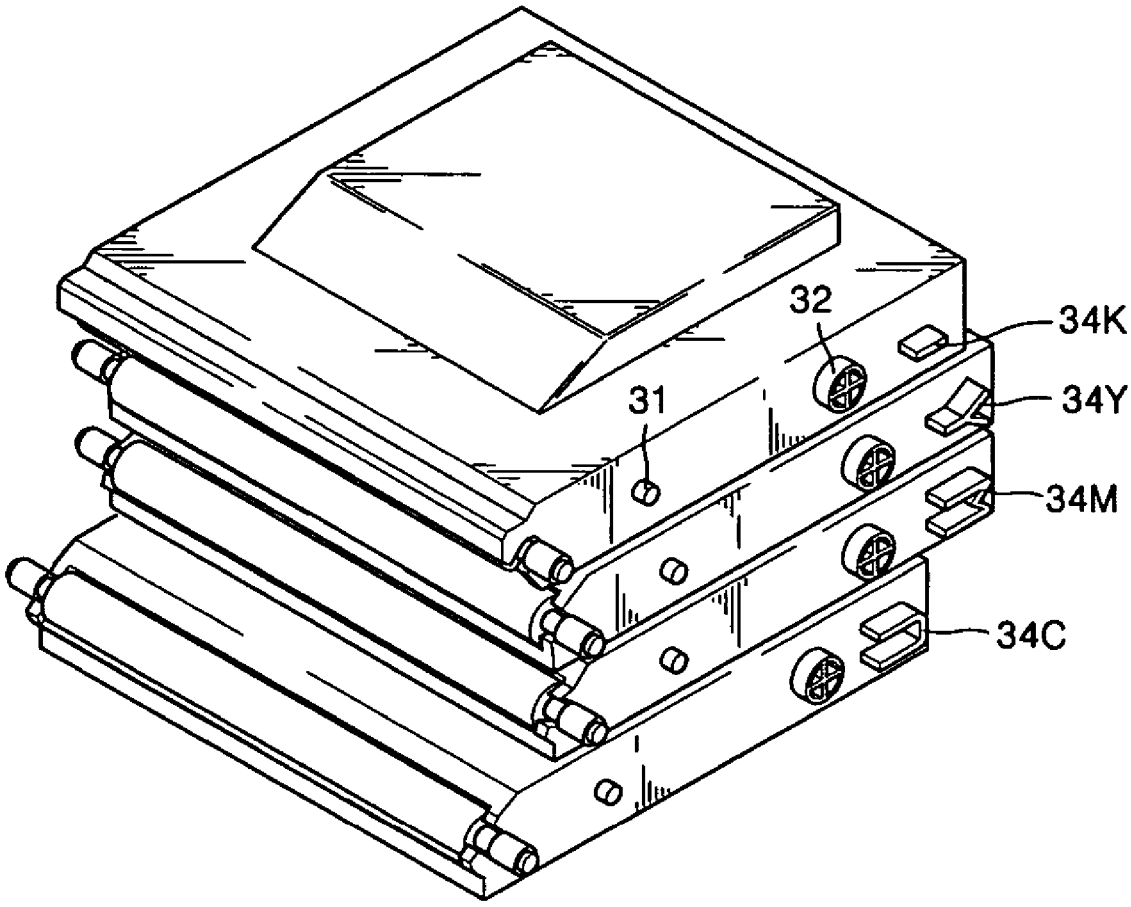

FIGS. 6 and 7 are perspective views of the developing device shown in FIG. 2.

Referring to FIG. 6, the developing device includes four development units 4C, 4M, 4Y and 4K. Cyan (C), magenta (M), yellow (Y) and black (K) toners are contained in the development units 4C, 4M, 4Y and 4K, respectively. Each of the development units 4C, 4M, 4Y and 4K has a developing roller 25 to supply the corresponding toner contained therein to the photosensitive drum 1.

A third supporting unit 31 and a fourth supporting unit 32, inserted into the third rail 130, are provided at both sides of each of the development units 4C, 4M, 4Y and 4K. In the embodiment of FIG. 6, the third supporting unit 31 and the fourth supporting unit 32 may be bosses projecting from lateral surfaces of each of the development units 4C, 4M, 4Y and 4K so as to be inserted into the third rail 130. As shown in FIG. 3, the third supporting unit 31 and the fourth supporting unit 32 can be inserted into the third rail 130, so that the development units 4C, 4M, 4Y and 4K are guided by the third rail 130 and slide in the horizontal direction X to then be mounted on the main frame 100.

Position determining members are provided in the respective development units 4C, 4M, 4Y and 4K to maintain a developing gap Dg between the developing roller 25 and the photosensitive drum 1 when the development units 4C, 4M, 4Y and 4K are mounted on the frame 100. In the illustrative embodiment of FIG. 6, a bushing 33 is used as the position determining member and can be installed at either side of the developing roller 25. The bushing 33 has a greater radius than the developing roller 25 by a dimension corresponding to the developing gap Dg. Thus, the respective development units 4C, 4M, 4Y and 4K slide along the third rail 130 and stop when the bushing 33 contacts the outer circumferential surface of the photosensitive drum 1, and the developing roller 25 is then spaced apart from the photosensitive drum 1 by the developing gap Dg.

Referring to FIGS. 2 through 6, the photosensitive drum unit 200 and the intermediate transfer unit 300 can be mounted on and dismounted from the main frame 100 in the vertical direction Z, and the development units 4C, 4M, 4Y and 4K can be mounted on or dismounted from the main frame 100 in the horizontal direction X. As described above, the development units 4C, 4M, 4Y and 4K can be arranged such that the developing gap Dg is maintained between the photosensitive drum 1 and the developing rollers 25. Thus, as shown in FIG. 1, the development units 4C, 4M, 4Y and 4K can be arranged in a manner that they surround one side of the photosensitive drum 1. The development units 4C, 4M, 4Y and 4K can also be symmetrical with one another in a vertical direction. Due to such characteristic arrangement of the photosensitive drum 1, the photosensitive drum unit 200, and the intermediate transfer belt 300, it is an aspect of this embodiment that the development units 4C, 4M, 4Y and 4K are preferably mounted in that order. However, the positioning of the developing units is not limited to this arrangement, and may be arranged in any order which provides the intended aspects and features of the present embodiment as described herein. The photosensitive drum unit 200 can be removed after at least the development units 4Y and 4K are retracted to a position at which they do not interfere with the photosensitive drum 1 during an upward extraction of the photosensitive drum unit 200.

The photosensitive drum unit 200, the intermediate transfer unit 300 and the developing device 4 are disposables that can be replaced when the service life is completed. As previously described, the photosensitive drum unit 200 may be mounted or dismounted in the lengthwise direction Y of the photosensitive drum 1. In this case, it is not necessary to extract the developing device 4 prior to mounting or dismounting of the photosensitive drum unit 200. A stroke required to mount or dismount the photosensitive drum unit 200 should be greater than the width of the sheet S used in the electrophotographic printer. In an electrophotographic printer that can be suitably used for A4 size sheets, the stroke should be at least 210 mm. In an electrophotographic printer that can be suitably used for A3 size sheets, the stroke should be at least 297 mm. In the conventional electrophotographic printer, the photosensitive drum 1 may be damaged during replacement due to a contact between the photosensitive drum 1 and other elements including the developing device 4. Specifically, in the case where the developing device 4 is arranged such that the developing roller 25 is spaced apart from the photosensitive drum 1 by a slight developing gap Dg, i.e., no more than several hundreds of microns, similar to the gap of the electrophotographic printer of this embodiment, the photosensitive drum 1 may contact the developing roller 25 even by a slight movement of the photosensitive drum unit 200 during replacement of the photosensitive drum unit 200, resulting in damage to a surface of the photosensitive drum 1. This may also occur when the developing device 4 is retracted in the lengthwise direction Y of the photosensitive drum 1 in a state in which the photosensitive drum unit 200 is mounted. Also, when the developing device 4 or the photosensitive drum unit 200 is mounted or dismounted in the lengthwise direction Y of the photosensitive drum 1, it is necessary to remove the waste toner storage container 400 prior to removal of the developing device 4 or the photosensitive drum unit 200.

In the electrophotographic printer according to this embodiment, the photosensitive drum unit 200 and the developing device 4 are mounted in different directions. That is, the developing device 4 is dismounted in a direction in which it moves away from the photosensitive drum 1, and mounted in a direction in which it moves close to the photosensitive drum 1. Thus, if there is provided at least a unit to maintain a gap between the photosensitive drum 1 and the developing roller 25, for example, the position determining unit 33, the photosensitive drum 1 and the developing roller 25 are not brought into contact with each other. Also, since the developing device 4 can be first extracted and the photosensitive drum unit 200 is then replaced, there is little possibility of the photosensitive drum 1 and the developing roller 25 contacting each other.

Figure 8:
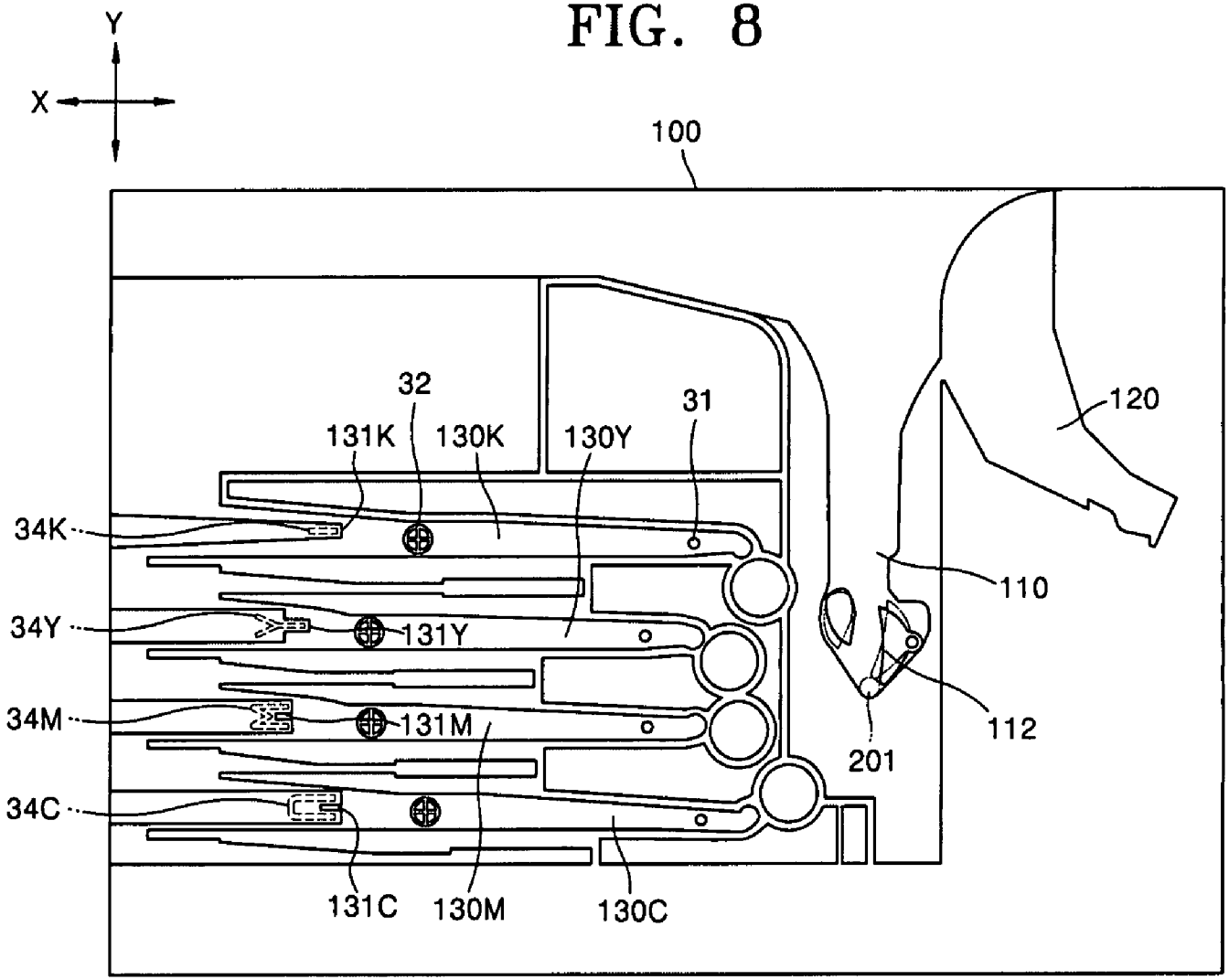
FIG. 8 is a detailed diagram of a recognition unit and a connection unit according to an embodiment of the present invention.

The four development units 4C, 4M, 4Y and 4K should not be mounted at places other than each third rail 130C, 130M, 130Y and 130K, respectively. Thus, the electrophotographic printer according to this embodiment includes erroneous insertion preventing units allowing the respective development units 4C, 4M, 4Y and 4K to be mounted on each of the third rails 130C, 130M, 130Y and 130K, respectively. The erroneous insertion preventing units can each include recognition units provided at the respective development units 4C, 4M, 4Y and 4K to have different shapes with respect to one another and connection units provided at the main frame 100 to be complementarily coupled to the recognition unit. Referring to FIG. 7, showing a perspective view illustrating the development units 4C, 4M, 4Y and 4K when viewed in an opposite direction from the previous figures, the recognition units 34C, 34M, 34Y and 34K, which are I-, Y-, M- and U-shaped, respectively, protrude at one side of the respective development units 4C, 4M, 4Y and 4K. Referring to FIG. 8, the third rails 130C, 130M, 130Y and 130K also have recessed connection units 131C, 131M, 131Y and 131K which couple to the recognition units 34C, 34M, 34Y and 34K, respectively. For example, if the development unit 4M is inserted into the third rail 131Y, since the recognition unit 34Y and the connection unit 131M can not be complementarily coupled to each other, the development unit 131Y can not be inserted into a position where the developing roller 25 and the photosensitive drum 1 are maintained at the developing gap Dg. Thus, as shown by a dashed line in FIG. 2, only when the development units 4C, 4M, 4Y and 4K are inserted into the third rails 130C, 130M, 130Y and 130K, respectively, the recognition units 34C, 34M, 34Y and 34K are coupled to the connection units 131C, 131M, 131Y and 131K, respectively, so that the development units 4C, 4M, 4Y and 4K are inserted to a position where the developing roller 25 and the photosensitive drum 1 are maintained at the developing gap Dg.

Figure 9:
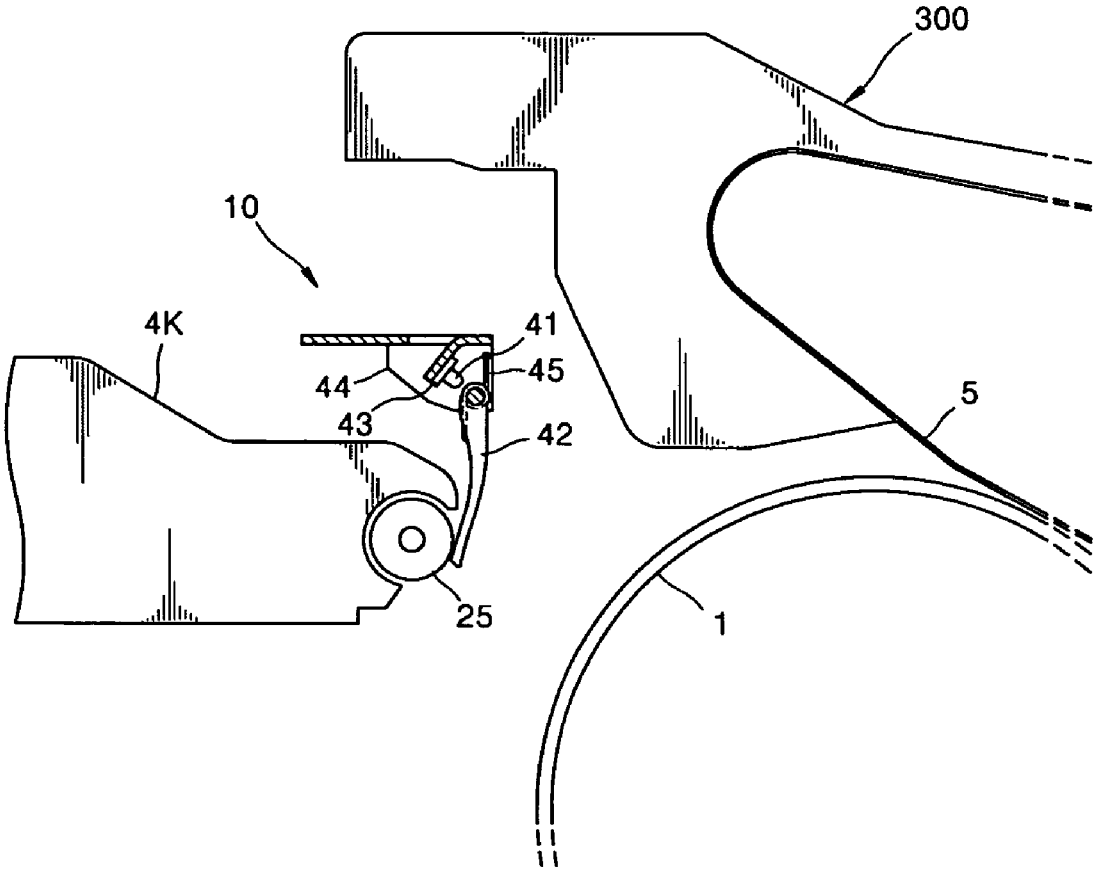
FIGS. 9 and 10 are side views illustrating a pre-transfer erasing unit shown in FIG. 2.
Figure 10:
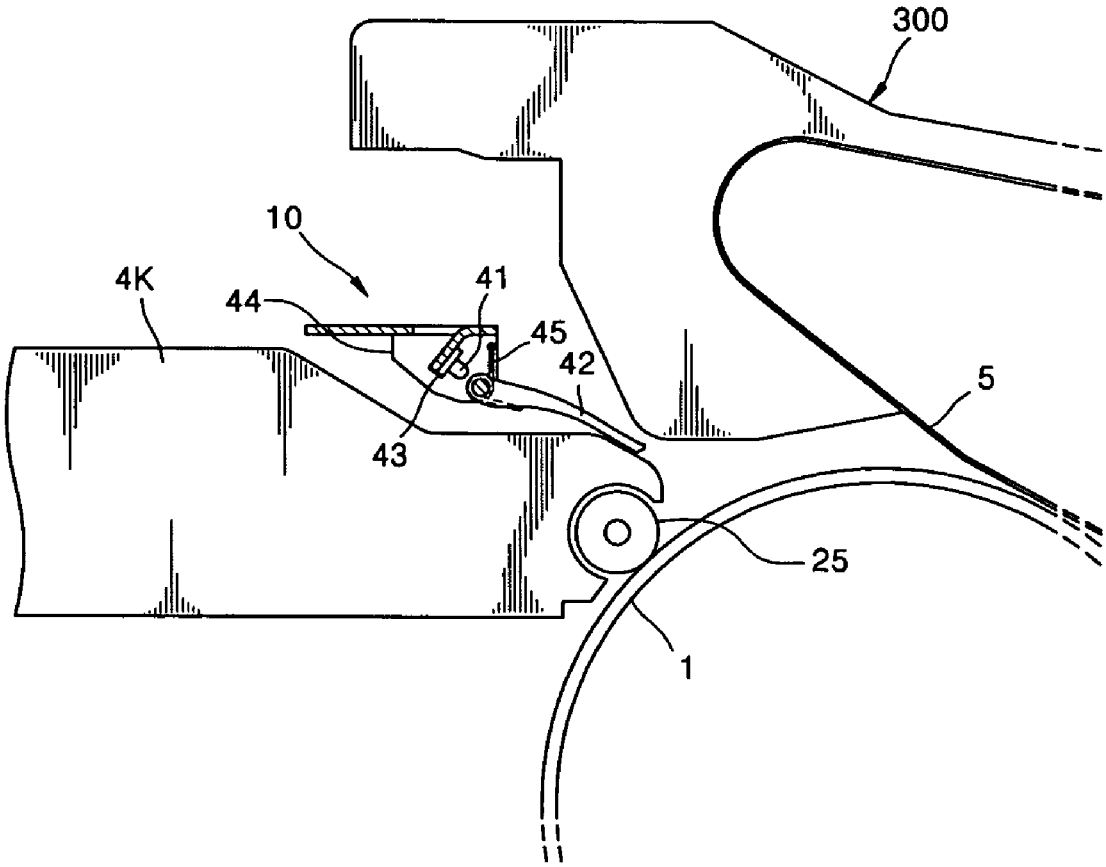

FIGS. 9 and 10 are detailed side views of the pre-transfer eraser 10 shown in FIG. 2. Referring back to FIG. 2, the pre-transfer eraser 10 can be positioned above the uppermost development unit 4K and can be fixedly installed on the main frame 100. In order to avoid interference occurring when the photosensitive drum 1 is mounted or dismounted in a vertical direction, the pre-transfer eraser 10 would usually have to be spaced apart from the outer circumference of the photosensitive drum 1 in a horizontal direction. In this usual case, however, a distance between the pre-transfer eraser 10 and the photosensitive drum 1 is too long to achieve effective erasure. Accordingly, the pre-transfer eraser 10 according to the illustrative embodiment as shown in FIGS. 9 and 10 includes a pre-transfer erasing lamp 41 and a pre-transfer erasing lens 42 to induce light generated from the pre-transfer erasing lamp 41 to a surface of the photosensitive drum 1. The pre-transfer erasing lens 42 can be movably installed such that it moves to an erasure position at which the pre-transfer erasing lens 42 is close to the photosensitive drum 1 so as to guide the light irradiated from the pre-transfer erasing lamp 41 for erasure, and to a retracted position spaced apart from the photosensitive drum 1 so as to mount or dismount the photosensitive drum unit 200. The pre-transfer erasing lamp 41 can be installed in plural numbers on a PCB 43 extending in a lengthwise direction of the photosensitive drum 1. Although not shown, the pre-transfer erasing lamp 41 may be installed at one end or both ends of the pre-transfer erasing lens 42 lengthwise.

Referring to FIG. 9, a holder 44 can be installed on a main frame 100, and the PCB 43 having a pre-transfer erasing lamp 41 can be fixed to the holder 44. The pre-transfer erasing lens 42 can be rotatably installed on the holder 41. Reference numeral 45 denotes an elastic member to apply an elastic force to the pre-transfer erasing lens 42 so that the pre-transfer erasing lens 42 rotates in a direction in which it retracts from the photosensitive drum 1.

A pre-transfer erasing procedure is performed between the development and transfer operations. The pre-transfer eraser 10 can be positioned between the developing device 4 and the transfer belt 5. The pre-transfer erasing lens 42 rotates to an erasure position and a retracted position according to attachment or detachment of the developing device 4. Like in the electrophotographic printer of the illustrative embodiment, if a plurality of development units 4C, 4M, 4Y and 4K are provided, the pre-transfer erasing lens 42 can rotate according to attachment and detachment of the development unit 4K closest to the transfer belt 5.

Referring to FIG. 9, when the development unit 4K retracts, the pre-transfer erasing lens 42 can be rotated to the retracted position by an elastic force of the elastic member 45. In this state, even if the photosensitive drum unit 200 is removed, the pre-transfer erasing lens 42 and the photosensitive drum 1 do not interfere with each other. If the photosensitive drum unit 200 is mounted and the development unit 4K is pushed in a horizontal direction towards the photoconductive drum unit 200, an upper end of the development unit 4K interferes with the pre-transfer erasing lens 42 such that the pre-transfer erasing lens 42 can rotate to an erasure position. If the development unit 4K is completely mounted, as shown in FIG. 10, the pre-transfer erasing lens 42 can reach the erasure position facing the photosensitive drum 1. If the development unit 4K is retracted from the mounted position, the pre-transfer erasing lens 42 can rotate to a rertacted position by an elastic force of the elastic member 45.

Although this illustrative embodiment has shown that the photosensitive drum 1 can be mounted or dismounted in a vertical direction, the pre-transfer eraser 10 according to this embodiment can be applied to the case in which the photosensitive drum 1 is slidably mounted or dismounted in the lengthwise direction Y, which is not shown in the drawings. In order to achieve erasure, the pre-transfer erasing lens 42 should be adjacent to an outer circumferential surface of the photosensitive drum 1. Thus, in the case where the photosensitive drum 1 is mounted or dismounted in the lengthwise direction Y, one way to prevent the photosensitive drum 1 from being damaged by the pre-transfer erasing lens 42 is to separate the pre-transfer erasing lens 42 from the photosensitive drum 1. Also, although the illustrative embodiment has shown that the development unit 4K can be mounted or dismounted in a horizontal direction, the pre-transfer eraser 10 according to this embodiment can also be configured such that even when the development unit 4K slides in the lengthwise direction Y of the photosensitive drum 1, the pre-transfer erasing lens 42 can move to an erasure position and a retracted position by a contact between the development unit 4K and the pre-transfer erasing lens 42 and an elastic force of the elastic member 45.

Figure 11:
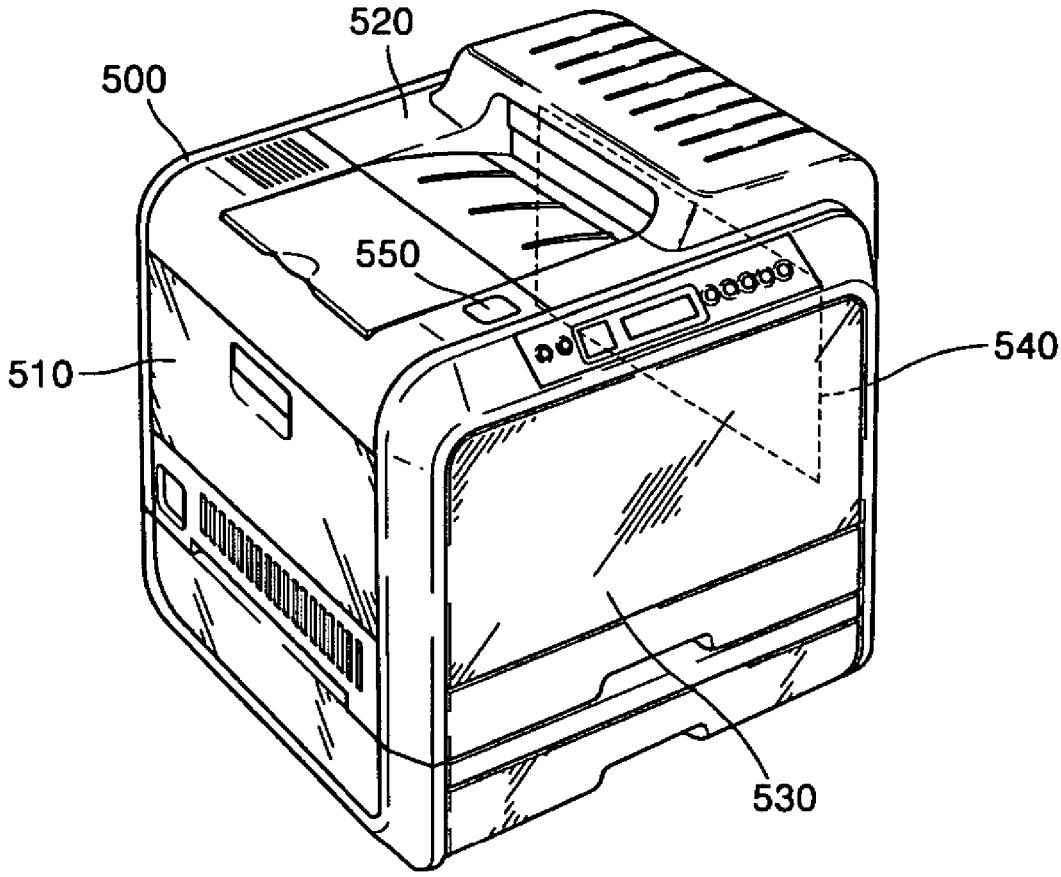
FIG. 11 is a perspective view illustrating an external appearance of the electrophotographic printer shown in FIG. 1.

FIG. 11 is a perspective view illustrating the external appearance of the electrophotographic printer shown in FIG. 1, according to another embodiment of the present invention.

Referring to FIG. 11, the electrophotographic printer according to this embodiment includes first through fourth doors 510, 520, 530 and 540. The first through fourth doors 510, 520, 530 and 540 to access the developing device 4, the photosensitive drum unit 200 and the intermediate transfer unit 300, the waste toner storage container 400, and the sheet transport unit 20, respectively, are provided to open left, top, front and right sides of a housing 500, respectively. Reference numeral 550 denotes an opening switch to open the second door 520. In an aspect of this embodiment, the first through third doors 510, 520 and 530 can be rotatably installed on the main frame 100. The fourth door 540 can be coupled to the sheet transport unit 20 rotatably installed on the main frame 100.

Figure 12:
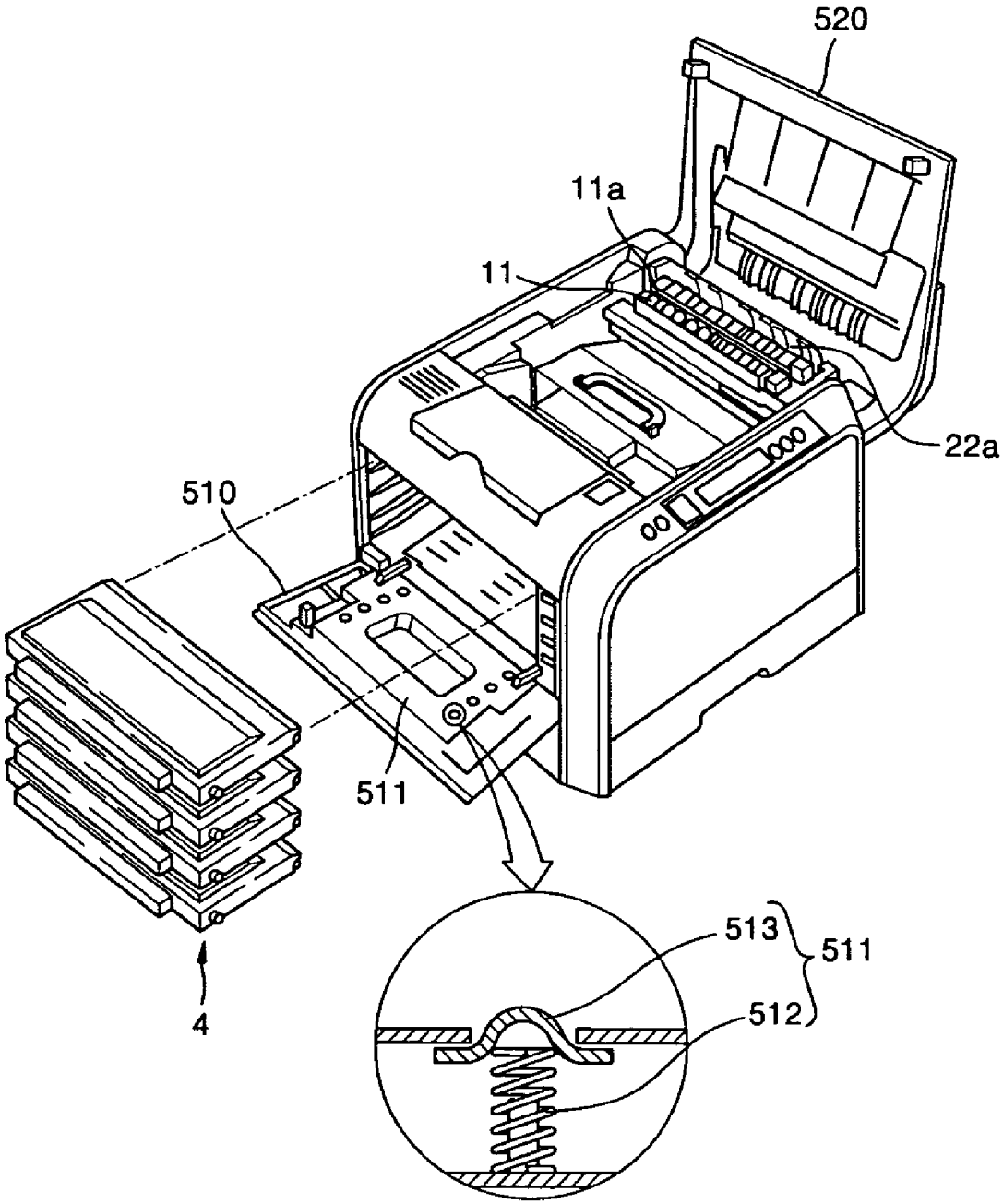
FIG. 12 is a perspective view illustrating a state in which a first door and a second door of the electrophotographic printer of FIG. 1 are opened.

FIG. 12 is a perspective view illustrating a state in which the first door 510 and the second door 520 of FIG. 11 can be opened.

Referring to FIG. 12, when the second door 520 is opened, the intermediate transfer unit 300 and the photosensitive drum unit 200 can be removed upward. Although not illustrated, the upper ejection roller (17*a* of FIG. 1) is separated from the lower ejection roller (17*b* of FIG. 1) when the second door 520 becomes opened. Then, an exit 11*a* of the fusing device 11 and an inlet 22*a* of the duplex path 22 can be opened. Thus, a sheet jam generated during fusing, ejecting and reversing for duplex printing, can be eliminated.

When the first door 510 is opened, the developing device 4 can be slidably mounted or dismounted in the horizontal direction X. Here, the erroneous insertion preventing unit to permit the developing device 4 to be mounted on a predetermined position of the third rail 130 (see FIG. 3) has been described with reference to FIGS. 7 and 8. A plurality of pressurizing units 511 to elastically push the developing device 4 toward the photosensitive drum 1 when the first door 510 is closed may be provided in the first door 510. FIG. 12 shows an example of the pressurizing units 511, illustrating a pressurizing member 513 elastically biased by a compression spring 512 and pushing the developing device 4 toward the photosensitive drum 1. The pressurizing unit 511 is not limited to that illustrated in FIG. 12 and may have a variety of alternative structures that provide the intended aspects and features of the present embodiment as described above.

Figure 13:
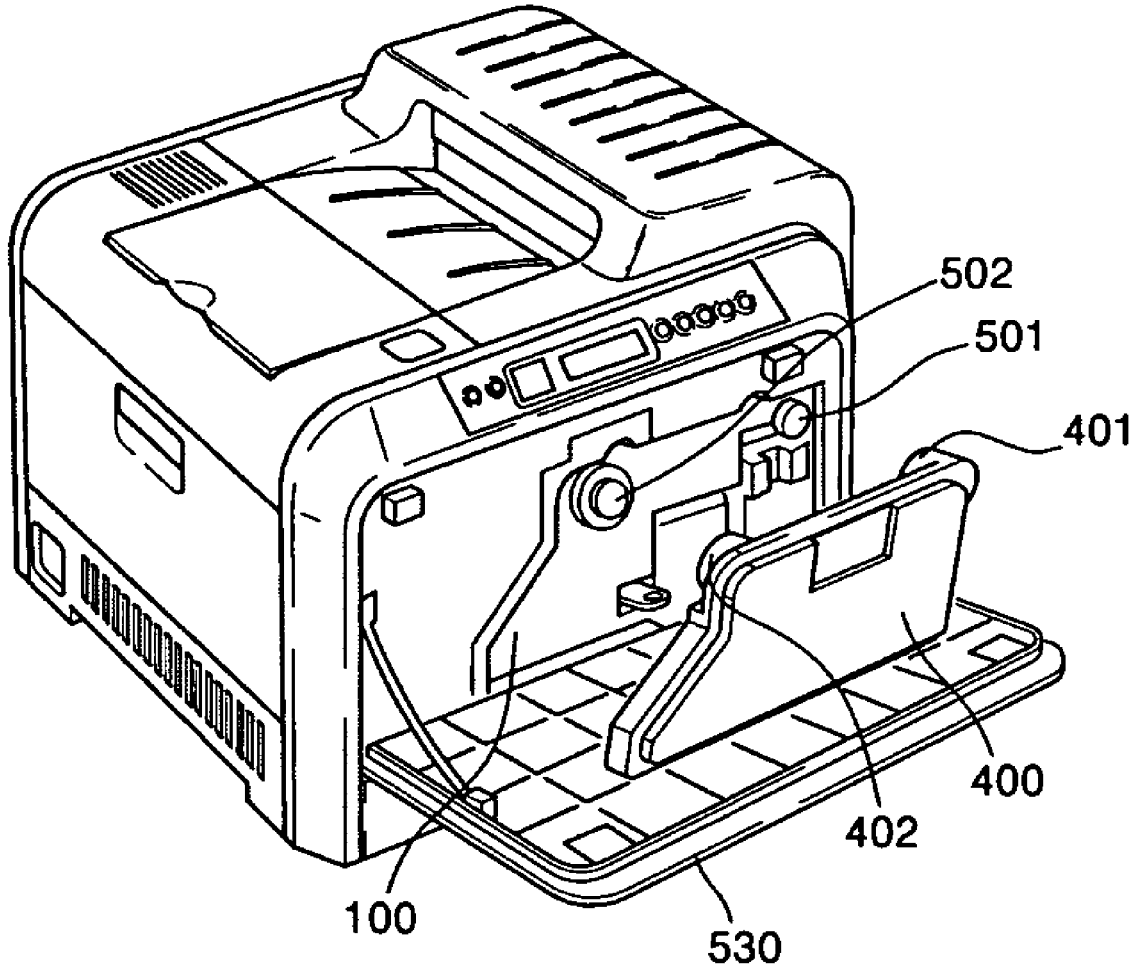
FIG. 13 is a perspective view illustrating a state in which a third door of the electrophotographic printer of FIG. 1 is opened.

FIG. 13 is a perspective view illustrating a state in which the third door 530 of FIG. 11 can be opened.

Referring to FIG. 13, there can be provided a waste toner storage container 400 having two inlets 401 and 402 through which a waste toner can be introduced, and two outlets 501 and 502 connected to the inlets 401 and 402, respectively. The outlets 501 and 502 are provided on a main frame 100. The inlets 401 and 402 can be close to an upper end of the waste toner storage container 400. The outlet 502 can be connected to the second cleaning device 9 (FIG. 1) provided in an intermediate transfer unit 300. Since the intermediate transfer unit 300 can be provided above the photosensitive drum unit 200, the first cleaning device 6 provided in the photosensitive drum unit 200 can be positioned below the second cleaning device 9. Thus, although not shown, the electrophotographic printer may further include a third transfer unit to transfer a waste toner from the first cleaning device 6 to the outlet 501. In such a manner, the waste toner removed from the transfer belt 5 and the photosensitive drum 1 are stored in the waste toner storage container 400.

Figure 14:
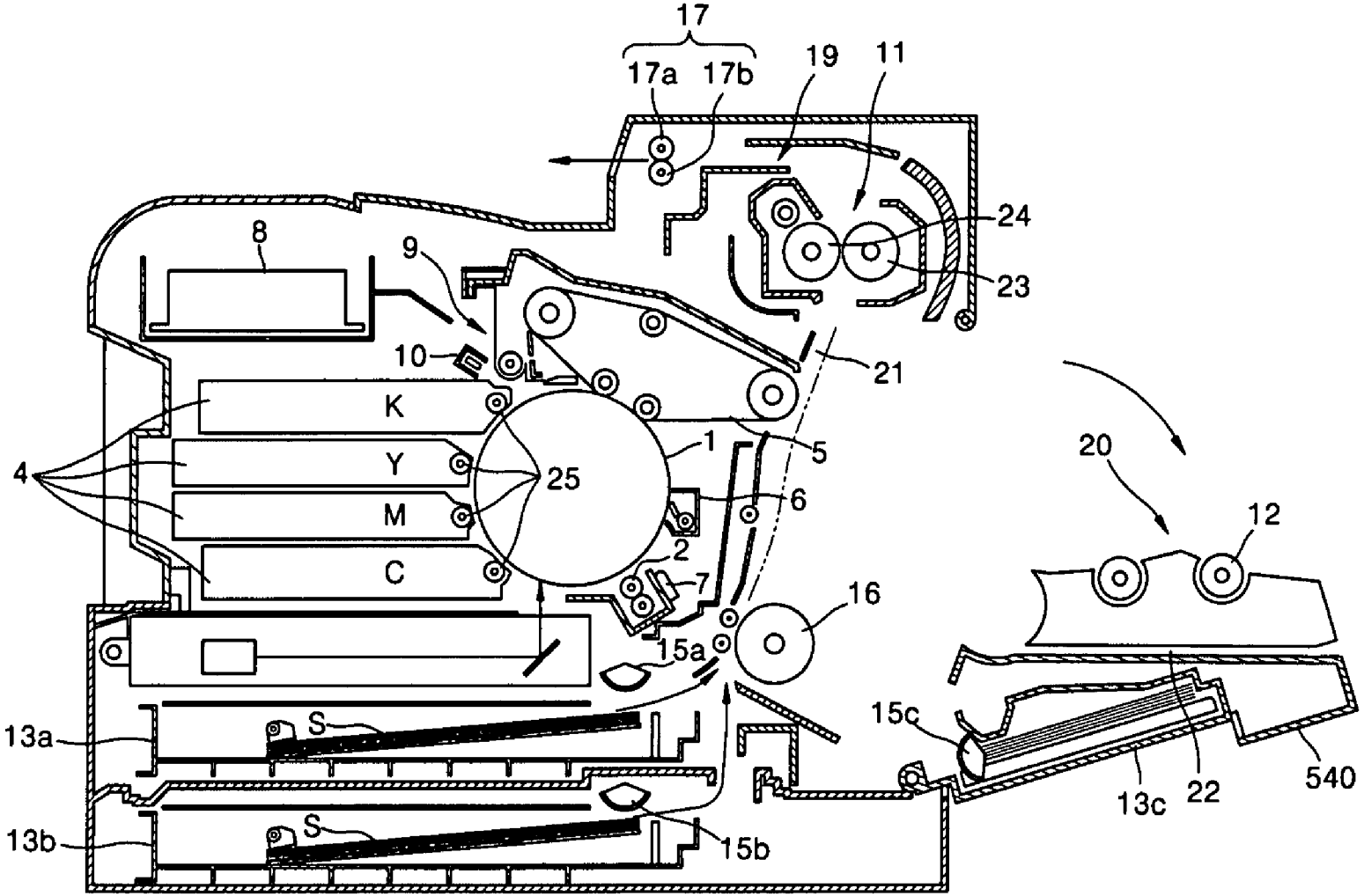
FIG. 14 is a perspective view illustrating a state in which a fourth door of the electrophotographic printer of FIG. 1 is opened.

FIG. 14 is a perspective view illustrating a state in which the fourth door 540 of FIG. 11 can be opened.

The fourth door 540 can be used to access the sheet transport unit 20. To this end, the sheet transport unit 20 can be rotatably installed on the main frame 100. The fourth door 540 can be coupled to the sheet transport unit 20. As shown in FIG. 14, as the fourth door 540 is opened, the sheet transport unit 20 rotates accordingly so that the roller 12 can be separated from the transfer belt 5, and the feed path 21 and the duplex path 22 extending from the feed roller 16 to the fusing device 11 are opened. Therefore, sheet jams generated at the feed path 21 and the duplex path 22 can be eliminated. Although the illustrative embodiment of FIG. 14 has not shown the feed roller 16 to rotate along with the fourth door 540, it may be configured to rotate.

Also, the MPF 13*c* can be provided in the fourth door 540. As shown in FIG. 1, the MPF 13*c* can be openably provided such that the sheet S can be transported through the MPF 13*c*.

As described above, in the electrophotographic printer according to this embodiment, a plurality of development units 4C, 4M, 4Y and 4K are mounted at one side of the photosensitive drum 1 so that the developing roller 25 is spaced apart from the photosensitive drum 1 by the developing gap Dg. When four development units 4C, 4M, 4Y and 4K are all positioned below the center of the photosensitive drum 1, the photosensitive drum 1 and the developing device 4 do not interfere with each other even if the photosensitive drum unit 200 is being extracted upward in a state in which the developing device 4 is mounted within the electrophotographic printer. In this case, however, usually the photosensitive drum 1 of a conventional electrophotographic printer should be very large or the developing device 4 should be very small. Thus, it is perferable that at least one of the development units 4C, 4M, 4Y and 4K is mounted above the center of the photosensitive drum 1, and unless it is extracted first, the photosensitive drum unit 200 cannot be mounted or dismounted in a vertical direction. In the present embodiment, however, since the development units 4C, 4M, 4Y and 4K are disposed symmetrically with respect to each other in a vertical direction in view of the center of the photosensitive drum 1, in order to mount or dismount the photosensitive drum unit 200, the development units 4Y and 4K should be first removed or the development units 4Y and 4K should be first retracted to a position at which it does not interfere with the photosensitive drum 1 when removing the photosensitive drum unit 200.

A user may open the first door 510 to retract or remove the development units 4Y and 4K so as not to interfere with the photosensitive drum 1, and then open the second door 520 to remove the photosensitive drum unit 200. Here, since the intermediate transfer unit 300 is positioned above the photosensitive drum unit 200, the intermediate transfer unit 300 may be first removed and the photosensitive drum unit 200 may then be removed.

In order to prevent the photosensitive drum 1 from being damaged, which may occur when the photosensitive drum unit 200 is to be removed without retracting or removing the development units 4Y and 4K, it is an aspect of this embodiment that the second door 520 can be opened only when the first door 510 is opened. Also, when the photosensitive drum unit 200 is to be mounted in a state in which the developing device 4 is mounted and the first door 510 is closed, the photosensitive drum 1 may also become damaged. Thus, it is an aspect of this embodiment that the first door 510 can be closed only when the second door 520 is closed. To this end, the electrophotographic printer according to this embodiment includes a door locking unit.

Even in a state in which the first door 510 is opened, if the second door 520 is opened to remove the photosensitive drum unit 200 without retracting or removing the development units 4Y and 4K, the photosensitive drum 1 may become damaged. The electrophotographic printer according to this embodiment includes a retracting unit to retract at least the development units 4Y and 4K being at a position at which it interferes with the photosensitive drum 1 in association with the opening operation of the first door 510 to a position at which it does not interfere with the photosensitive drum 1.

Figure 15:
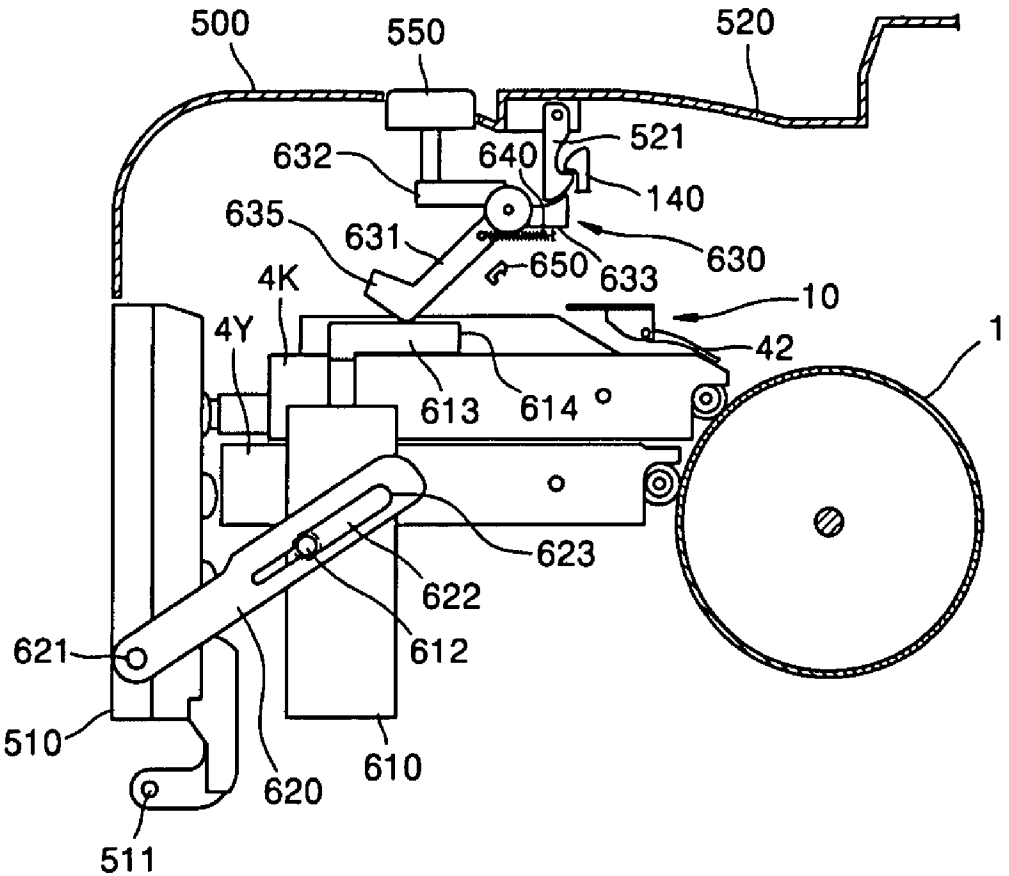
FIGS. 15, 16 and 17 are side views of a door locking unit and retracting units of the electrophotographic printer of FIG. 11.
Figure 16:
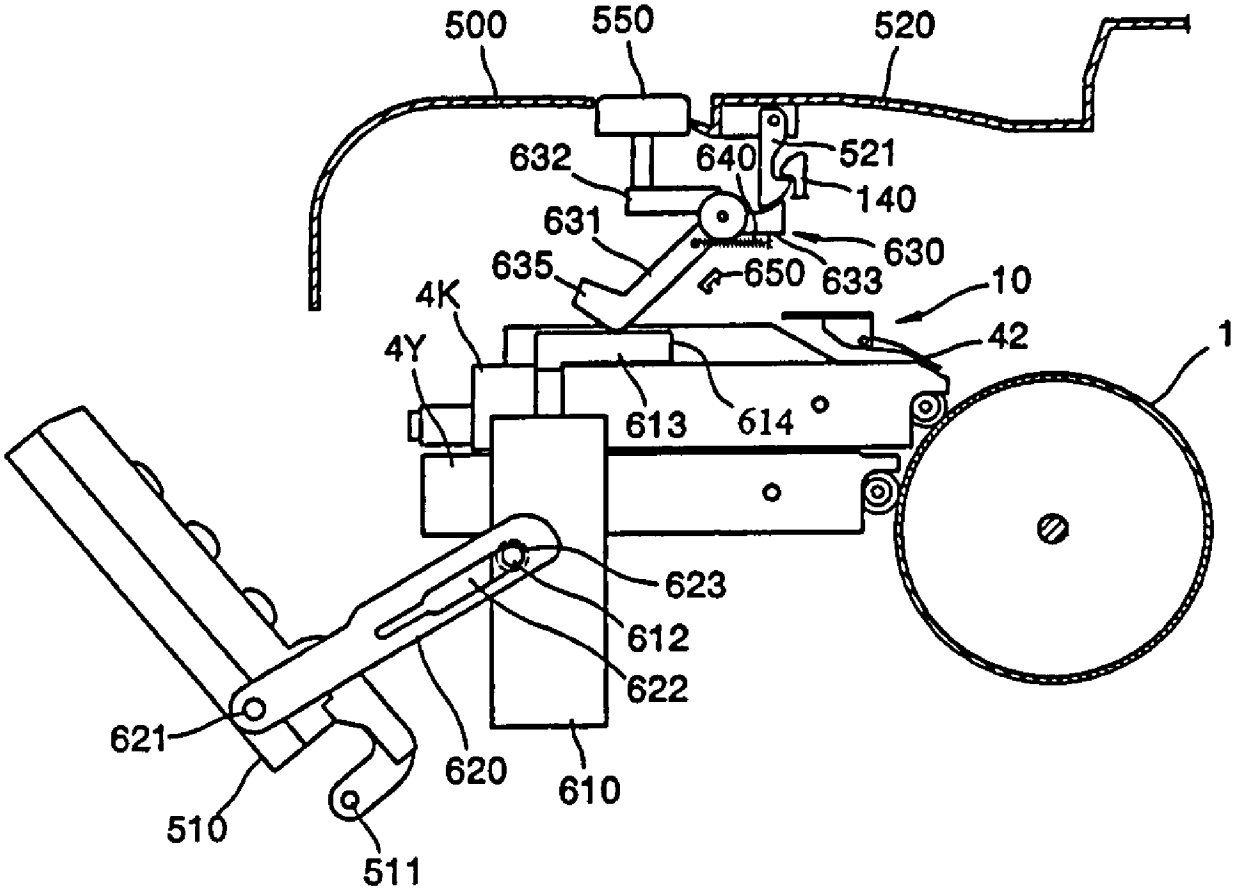
Figure 17:
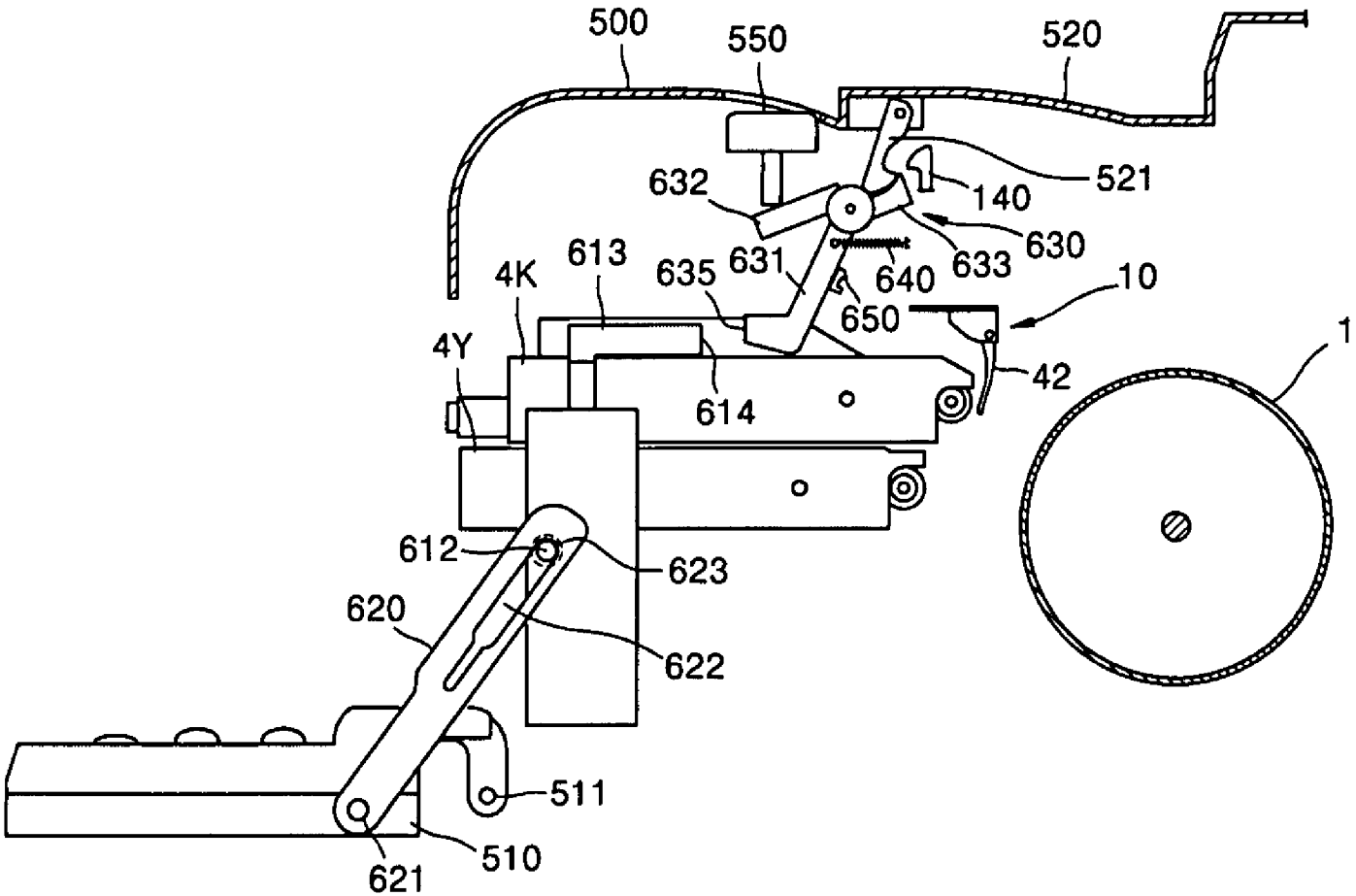
Figure 18:
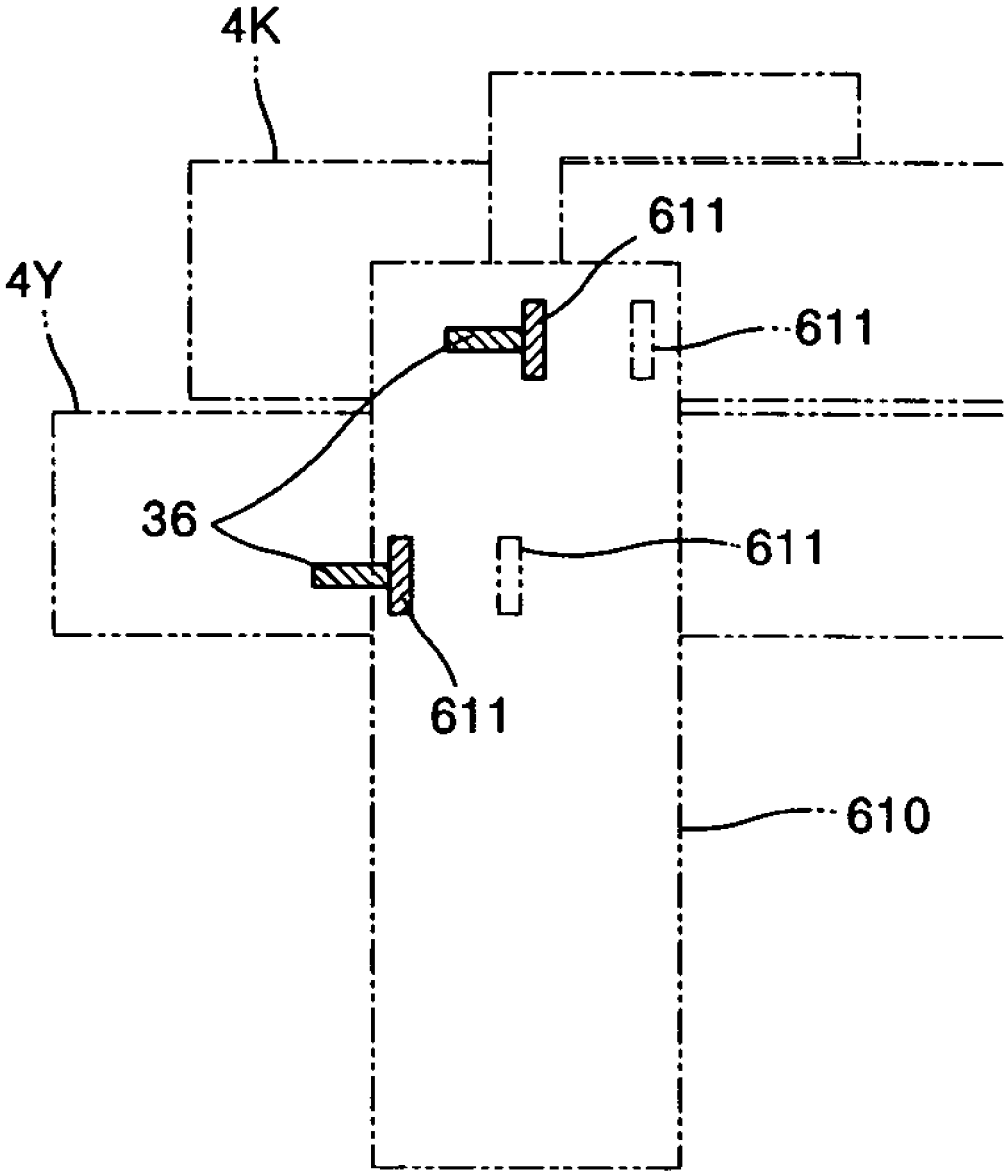
FIG. 18 illustrates a connection state of a first connection unit and a second connection unit of the electrophotographic printer of FIG. 11.

FIGS. 15, 16 and 17 are side views of a door locking unit and a retracting unit, and FIG. 18 illustrates a connection state of a first connection unit and a second connection unit.

Referring to FIG. 15, a first member 610 slides in association with the opening operation of the first door 510. In order to make the first member 610 slide according to the opening operation of the first door 510, a second member 620 connected to the first member 610 can be rotatably installed in the first door 510. One end 621 of the second member 620 can be slightly spaced apart from a hinge 511 and rotatably connected to the first door 510.

As shown in FIG. 6, a first connection unit 36 can be provided in each of the upper development units 4Y and 4K and can protrude from a side portion of the upper development units 4Y and 4K. A second connection unit 611 coupled to the first connection unit 36 can be provided in the first member 610, as shown in FIG. 18. The second connection unit 611 may be shaped as a slot into which the first connection unit 36 can be inserted, or as a rib protruding from a rear surface of the first member 610. According to this embodiment, the first member 610 can be slidably installed on the main frame 100. The first member 610 may include a third connection unit 612, and the second member 620 may include a fourth connection unit 622 coupled to the third connection unit 612.

Opening positions of the first door 510 may include a first position (FIG. 16) at which the first door 510 is opened without the development units 4Y and 4K being retracted, and a second position (FIG. 17) at which the first door 510 is opened with the development units 4Y and 4K being retracted. To this end, when the first door 510 is opened to the first position, the following two methods are employed. First, the third connection unit 612 and the fourth connection unit 622 are formed so that the first member 610 may not slide while the first door 510 is opened to the first position. Second, the first connection unit 36 and the second connection unit 611 are formed so that the development units 4Y and 4K may not retract even if the first member 610 slides while the first door 510 is opened to the first position.

As the first door 510 is opened, the first member 610 may slide so that the second connection unit 611 can be coupled to the first connection unit 36 to permit the development units 4Y and 4K to retract. Then, the second connection unit 611 can be disconnected from the first connection unit 36 so that a user can remove the development units 4Y and 4K completely. According to the first method, the second connection unit 611 may be spaced a predetermined distance apart from the first connection unit 36, as indicated by a dotted line shown in FIG. 18, in a state in which the first door 510 is closed. According to the second method, the second connection unit 611 may be provided to contact the first connection unit 36, as indicated by a solid line shown in FIG. 18.

As the first door 510 is opened, the second member 620 can rotate. Accordingly, the first member 610 must move linearly. Thus, it is an aspect here that the third connection unit 612 and the fourth connection unit 622 are shaped so as to rotate with respect to each other. As shown in FIG. 15, in the first method, a slot perforating the second member 620 is used as the fourth connection unit 622. A circular boss protruding from the first member 610 and inserted into the slot can be used as the third connection unit 612. As shown in FIG. 15, in a state in which the first door 510 is closed, the third connection unit 612 can be positioned about midway of the fourth connection unit 622. In the second method, the fourth connection unit 622 may be a slot formed through the second member 620 in a circular shape so as to be spaced a minimum spacing apart from and connected to the third connection unit 612 shaped of a circular boss, as indicated by a dotted line shown in FIG. 15. In the illustrative embodiment, to form the first through the fourth connection units 36, 611, 612 and 622, the first method is employed.

Referring to FIG. 15, a hook 521 can be installed in the second door 520. The hook 521 can be coupled to the locking projection 140 provided on the main frame 100 in a state in which the second door 520 is closed. In the illustrative embodiment, the opening switch 550 can be installed in the housing 500. Alternatively, the opening switch 550 may be installed in the main frame 100. An interference unit 613 can be provided in the first member 610. The third member 630 can be installed in the main frame 100, and can be rotated accordingly as the opening switch 550 is pressed. The third member 630 may include a first arm 631 selectively interfered with by the interference unit 613, a second arm 632 interfering with the opening switch 550, and a third arm 633 to remove a connection between the hook 521 and the locking projection 140 as the opening switch 550 is pressed. The interference unit 613 can interfere with the first arm 631 in a state in which the first door 510 is closed, so that the third member 630 does not rotate even if the opening switch 550 is pressed, as shown in FIG. 15. Also, the first arm 631 can be interfered with by the interference unit 613 so that the first member 610 may not slide when the first door 510 is closed in a state in which the second door 520 is opened, as shown in FIG. 17. The hook 521 can rotate the third member 630 to a position shown in FIG. 15 by pressing the third arm 633 when the second door 520 is closed. Reference numeral 640 denotes a tension spring having one end that can be connected to the main frame 110 and another end that can be connected to the third member 630. The tension spring 640 provides an elastic force to the third member 630 so that the third member 630 rotates to a position at which the first arm 631 is interfered with by the interference unit 613. Reference numeral 650 denotes a stopper to restrict the third member 630 from rotating excessively by the elastic force of the tension spring 640. Reference numeral 650 denotes a stopper to restrict the third member 630 from rotating excessively by the elastic force of the tension spring 640.

The operation of the door locking unit and the retracting unit in associated with the opening operation of the first door 510 will now be described.

Even if the opening switch 550 is pressed in a state in which the first door 510 is closed, as shown in FIG. 15, since the first arm 631 contacts an upper portion of the interference unit 613, the third member 630 does not rotate. Thus, the connection between the hook 521 and the locking projection 140 is not removed, so that the second door 520 is not opened.

The opening operation of the first door 510 will now be described. Referring to FIGS. 15 and 16, even if the first door 510 is opened and the second member 620 is rotated, the first member 610 does not slide nor are the development units 4Y and 4K retracted until an end 623 of the fourth connection unit 622 contacts the third connection unit 612. Thus, the first door 510 can be opened to the first position smoothly. Even if the first door 510 is opened to the first position, since the first member 610 does not slide, the first arm 631 remains interfered with by the interference unit 613 so that the opening switch 550 is not pressed.

If the first door 510 starts to be opened from the first position to the second position, the end 623 of the fourth connection unit 622 comes into contact with the third connection unit 612 so that the second member 620 pulls the first member 610 in a retracting direction of the development units 4Y and 4K. Accordingly, a second connection unit 611 of FIG. 8 pushes the first connection unit 36 and the development units 4Y and 4K start to retract. If the first door 510 is completely opened to the second position, as shown in FIG. 17, the development units 4Y and 4K retreat to a position at which they do not interfere with the photosensitive drum 1 even if the photosensitive drum unit 200 is removed. Also, since interference between the interference unit 613 and the first arm 631 is terminated, pressing of the opening switch 550 permits the second arm 632 to be pressed so that the third member 630 is rotated. Also, the third arm 633 pulls the hook 521 to cancel a connection between the hook 521 and the locking projection 140, thereby opening the second door 520. Here, the third member 630 is rotated such that the first arm 631 is positioned on a sliding path of the interference unit 613. In a state in which the first door 510 and the second door 520 are opened, as shown in FIG. 12, the development units 4C, 4M, 4Y and 4K, the photosensitive drum unit 200, and the intermediate transfer unit 300 can be mounted or dismounted.

In the case where the first door 510 is closed in a state in which the second door 520 is opened, the first member 610 slides in a reverse direction. As shown in FIG. 17, in a state in which the second door 520 is opened, since the first arm 631 is positioned on the sliding path of the interference unit 613, an end 614 of the interference unit 613 is interfered with by an end 635 of the first arm 631 so that the first member 610 cannot slide. Thus, the first door 510 can not be further closed. If the second door 520 is closed, the hook 521 pushes the third arm 633 to rotate the third member 630 in the opposite direction to the case where the opening switch 550 is pressed. Then, the first arm 631 is positioned above the sliding path of the interference unit 613, as shown in FIG. 15. In such a state, even if the first door 510 is closed, since the interference unit 613 is not interfered with by the first arm 631, the first door 510 can be closed smoothly.

Based on the above-described configuration, the photosensitive drum unit 200 and the developing device 4 can be mounted or dismounted as follows.

In order to extract the photosensitive drum unit 200, as shown in FIG. 12, the first door 510 is first opened and the opening switch 550 can then pressed to open the second door 520. As shown in FIGS. 15 through 17, when the first door 510 is opened, the development units 4Y and 4K retract in a horizontal direction by the respective retracting units, and the door locking unit permits the opening switch 550 to operate. As shown in FIGS. 9 and 10, the pre-transfer erasing lens 42 of the pre-transfer eraser 10 is rotated to a retracted position by an action of the elastic member 45, at which it does not interfere with the photosensitive drum 1 as the development unit 4K retracts. In such a state, the intermediate transfer unit 300 and the photosensitive drum unit 200 can be sequentially raised upward to then be ejected.

The mounting of the photosensitive drum unit 200 and the intermediate transfer unit 300 is performed in the opposite sequence to the ejecting operation. First, an end of the shaft 201 of the photosensitive drum unit 200 can be inserted into the first rail 110 and pushed downward. Then, the second supporting unit 309 of the intermediate transfer unit 300 can be inserted into the second rail 120 and the intermediate transfer unit 300 can be tilted so that the first supporting unit 308 can be inserted into the first rail 110 to be pushed downward. Then, the second door 520 can be closed. Next, the development units 4C, 4M, 4Y and 4K can be mounted in a horizontal direction along the third rail 130. Here, the development unit 4K pushes the pre-transfer erasing lens 42 to rotate the same to the erasure position. Then, the first door 510 can be closed.

As described above, in a state in which the photosensitive drum unit 200, the intermediate transfer unit 300, and the development units 4C, 4M, 4Y and 4K are mounted, unless the first door 510 is opened, the second door 520 can not be opened. Thus, the photosensitive drum unit 200 and the intermediate transfer unit 300 cannot be ejected. Also, unless the second door 520 is closed, the first door 510 can not be closed. Thus, after the development units 4C, 4M, 4Y and 4K are first mounted and the first door 510 is closed, the photosensitive drum unit 200 and the intermediate transfer unit 300 can not be mounted. In such a manner, according to the present invention, there are provided the door locking unit, the developing device retracting units and the pre-transfer erasing lens 42 having an erasure position and a retracted position. Therefore, the photosensitive drum 1 can be prevented from being damaged due to a user's error causing interference of the developing device 4 and/or the pre-transfer erasing lens 42.

As described above, the electrophotographic printer according to the present invention has at least the following advantages.

First, the door locking unit is configured such that the second door is not opened when the first door is not opened, and also the first door is not closed when the second door is opened. Thus, the photosensitive drum can be prevented from being damaged due to an interference between the developing device and the photosensitive drum when the developing device and the photosensitive drum are mounted or dismounted.

Also, when the first door is opened, the retreating unit retracts the developing device to a position at which the developing device does not interfere with the photosensitive drum. Thus, a functional combination of the retracting unit and the door locking unit can remarkably reduce a damage problem of the photosensitive drum due to a user's carelessness when the developing device and a photosensitive drum unit are mounted or dismounted.

Further, when the developing device is retracted by the retracting unit, the pre-transfer erasing lens also retreats to a retreated position. Thus, the photosensitive drum can be prevented from being damaged due to an interference with the pre-transfer erasing lens.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An electrophotographic printer comprising:

a main frame;

a photosensitive drum unit having a photosensitive drum and vertically detachably installed on the main frame;

a plurality of development units each having a developing roller and detachably installed on the main frame while sliding in a horizontal direction;

a first door installed to open and close a portion of the main frame to mount or dismount the plurality of development units on the main frame; and a retracting unit to retreat at least one of the development units being positioned above a center of the photosensitive drum in association with an opening operation of the first door to a position at which the development unit does not interfere with the photosensitive drum when the photosensitive drum unit is mounted or dismounted in a vertical direction.

2. The electrophotographic printer of claim 1, wherein the first door comprises a pressurizing unit to elastically push each of the plurality of development units toward the photosensitive drum.

3. The electrophotographic printer of claim 1, wherein the first door is opened to either a first opening position or a second opening position, and when the first door is opened from the first opening position to the second opening position, the retracting unit retracts the at least one of the development units being positioned above the center of the photosensitive drum to a position at which the at least one of the development units does not interfere with the photosensitive drum when the photosensitive drum unit is mounted or dismounted in a vertical direction.

4. The electrophotographic printer of claim 1, wherein the retracting unit comprises:

a first connection unit provided in each of the development units; and a first member having a second connection unit coupled to the first connection unit and sliding in a direction in which the at least one of the development units retracts in association with an opening operation of the first door.

5. The electrophotographic printer of claim 4, wherein the first door is opened to either a first opening position or a second opening position, and the first connection unit and the second connection unit are spaced apart from each other and come in contact with each other when the first door is opened from the first opening position to the second opening position, so that the at least one of the development units is retracted.

6. The electrophotographic printer of claim 4, wherein the retracting unit comprises:

a third connection unit provided in the first member; and a second member having a fourth connection unit coupled to the third connection unit and rotatably installed in the first door to pull the first member in a retracting direction as the first door is opened.

7. The electrophotographic printer of claim 6, wherein the first door moves between a first opening position and a second opening position, and the third connection unit is shaped of a boss formed in the first member and the fourth connection unit is shaped of a slot into which the boss is inserted so that when the first door is opened from the first opening position to the second opening position, an end of the slot is brought into contact with the boss to pull the first member in the retracting direction.

8. The electrophotographic printer of claim 1, further comprising:

a pre-transfer eraser to remove charges from a non-image region of the photosensitive drum by irradiating light onto the photosensitive drum before the toner image formed on the photosensitive drum is transferred to the transfer belt, wherein the pre-erasing unit comprises:

a plurality of pre-erasing lamps irradiating the light;

a pre-transfer erasing lens to induce the light generated from the pre-transfer erasing lamp to the photosensitive drum, and movably installed such that it moves to an erasure position at which the pre-transfer erasing lens is close to the photosensitive drum for erasure, and moves to a retracted position spaced apart from the photosensitive drum so as not to interfere with the photosensitive drum when the photosensitive drum unit is being mounted or dismounted; and an elastic member to provide an elastic force in a direction in which the pre-transfer erasing lens is moved to the retracted position, and wherein when the respective development units are mounted, the uppermost development unit contacts and pushes the pre-transfer erasing lens to the erasure position to contact the uppermost development unit, and when the development unit is retracted by the retracting unit, the pre-transfer erasing lens moves to the retracted position by the elastic force of the elastic member.

9. The electrophotographic printer of claim 1, further comprising:

a second door to be opened to mount or dismount the photosensitive drum unit;

an opening switch to open the second door; and a door locking unit to allow the opening switch to operate the second door to be opened only when the first door is opened.

10. The electrophotographic printer of claim 9, wherein the door locking unit allows the first door to be closed only when the second door is closed.

11. The electrophotographic printer of claim 9, wherein the door locking unit comprises:

a first member having an interference unit and installed on the main frame to slide in association with an opening operation of the first door; and a third member installed to be movable as the opening switch operates, and selectively being interfered with by the interference unit according to opening or closing of the first door to selectively control the opening switch to operate.

12. The electrophotographic printer of claim 11, wherein the door locking unit comprises a second member having one end connected to the second door and the other end connected to the first member to make the first member slide as the first door is opened.

13. The electrophotographic printer of claim 11, wherein the third member and the interference unit control the first door to be closed only when the second door is closed such that they interfere with each other in a state in which the second door is opened so as to make the first member not slide.

14. An electrophotographic printer comprising:

a housing having a top, a bottom, and a side disposed between the top and the bottom;

a main frame disposed on the housing;

a photosensitive drum unit having a photosensitive drum and slidably installed on the main frame in a first direction;

at least one development unit having a developing roller and slidably installed on the main frame in a second direction different from the first direction;

a first door installed on the housing to open and close the side of the housing to allow the at least one development unit to be mounted on and dismounted from the main frame through the side of the housing;

a retreat unit to retreat the developing roller from the photosensitive drum unit when the photosensitive drum unit is dismounted from the main frame, to prevent an interference between the photosensitive drum and the at least one development unit.

15. The electrophotographic printer of claim 14, further comprising:

a second door installed on the housing to open and close the top of the housing to allow the photosensitive drum unit to be mounted on and dismounted from the main frame through the top of the housing.

16. The electrophotographic printer of claim 15, wherein the second door is not opened when the first door is not opened to prevent damage of the photosensitive drum due to an interference between the photosensitive drum and the at least one development unit.

17. The electrophotographic printer of claim 15, further comprising:

a locking unit to lock and unlock the second door according to a movement of the first door to prevent damage of the photosensitive drum when the photosensitive drum is dismounted from the main frame in a state that the first door is not opened.

18. The electrophotographic printer of claim 15, further comprising:

a locking unit to lock and unlock the second door according to a movement of the development unit to prevent the photosensitive drum unit from being dismounted from the main frame while the developing roller contacts the photosensitive drum.

19. The electrophotographic printer of claim 15, wherein the photosensitive drum unit is mounted on and dismounted from the main frame according to a movement of the first door.

20. The electrophotographic printer of claim 14, wherein the first and second directions are perpendicular to each other to reduce a mounting stroke of the photosensitive drum unit.

21. The electrophotographic printer of claim 14, wherein the photosensitive drum unit and the at least one development unit are not simultaneously mounted on and dismounted from the main frame.

22. An electrophographic printer comprising:

a housing including first and second doors positioned at two adjacent sides thereof;

a development unit slidably installed into the housing through the first door to be mountable adjacent to a photoconductive drum unit to develop an image thereon; and a door controlling unit to control the second door from being opened unless the development unit is retracted away from the photosensitive drum unit by a predetermined distance.

23. The electrophotographic printer of claim 22, wherein the door controlling unit comprises a retracting unit to retract the development unit away from the photoconductive drum unit when the first door is opened and prevents the development unit from being mountable adjacent to the photoconductive drum unit unless the second door is closed.

24. The electrophotographic printer of claim 23, wherein the door controlling unit comprises an interfering unit to prevent the first door from closing until the second door is closed.

25. The electrophotographic printer of claim 22, wherein the second door is positioned on a top position of the housing and the first door is positioned on a side of the housing.

26. An electrophotographic printer comprising:

a main frame;

a photosensitive drum unit having a photosensitive drum and vertically detachably installed on the main frame;

a plurality of development units each having a developing roller and detachably installed on the main frame while sliding in a horizontal direction;

a first door installed to open and close a portion of the main frame to mount or dismount the plurality of development units on the main frame;

a second door to be opened to mount or dismount the photosensitive drum unit;

an opening switch to open the second door; and a door locking unit to allow the opening switch to operate the second door to be opened only when the first door is opened.

* * * * *